US012060693B2

(12) United States Patent
Ito

(10) Patent No.: US 12,060,693 B2
(45) Date of Patent: Aug. 13, 2024

(54) SHOVEL AND CONTROLLER FOR SHOVEL

(71) Applicant: SUMITOMO HEAVY INDUSTRIES, LTD., Tokyo (JP)

(72) Inventor: Tsutomu Ito, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 582 days.

(21) Appl. No.: 17/319,445

(22) Filed: May 13, 2021

(65) Prior Publication Data

US 2021/0262191 A1 Aug. 26, 2021

Related U.S. Application Data

(63) Continuation of application No. PCT/JP2019/044784, filed on Nov. 14, 2019.

(30) Foreign Application Priority Data

Nov. 14, 2018 (JP) ..... 2018-214165

(51) Int. Cl.
*E02F 3/32* (2006.01)
*E02F 3/43* (2006.01)

(52) U.S. Cl.
CPC ..... *E02F 3/435* (2013.01); *E02F 3/32* (2013.01)

(58) Field of Classification Search
CPC ..... E02F 9/2228; E02F 9/26; E02F 9/2037; E02F 9/123; E02F 3/32; E02F 9/2235; E02F 9/2242; E02F 3/435; E02F 9/205; E02F 9/267; E02F 9/262; E02F 9/2033
See application file for complete search history.

(56) References Cited

U.S. PATENT DOCUMENTS 4,768,339 A * 9/1988 Aoyagi ..... E02F 9/2296 60/427
9,464,406 B2 10/2016 Matsuyama et al.
2009/0301075 A1* 12/2009 Morinaga ..... E02F 9/2037 60/459

(Continued)

FOREIGN PATENT DOCUMENTS

JP S63-093936 4/1988
JP H07-026577 1/1995

(Continued)

OTHER PUBLICATIONS

International Search Report for PCT/JP2019/044784 mailed on Jan. 28, 2020.

*Primary Examiner* — Stephen Holwerda
(74) *Attorney, Agent, or Firm* — IPUSA, PLLC

(57) ABSTRACT

A shovel includes a lower traveling body, an upper turning body turnably mounted on the lower traveling body, an attachment attached to the upper turning body, a plurality of actuators including a first actuator and a second actuator and configured to drive the attachment and the upper turning body, and a processor configured to control an operation of the second actuator in accordance with an operation of the first actuator, wherein the processor is configured to, in response to determining that a predetermined condition on the operation of the second actuator is satisfied, control the operation of the first actuator such that the operation of the second actuator corresponds to the operation of the second actuator.

11 Claims, 15 Drawing Sheets

(56) References Cited

U.S. PATENT DOCUMENTS

| | | | | |
|---|---|---|---|---|
| 2010/0268407 | A1* | 10/2010 | Yanagisawa | B60K 6/46 180/65.265 |
| 2012/0165962 | A1* | 6/2012 | Faivre | G05B 19/106 700/19 |
| 2012/0285157 | A1* | 11/2012 | Okano | E02F 9/2285 60/445 |
| 2014/0371995 | A1* | 12/2014 | Udagawa | E02F 9/2037 701/50 |
| 2018/0209122 | A1* | 7/2018 | Kiyota | E02F 9/26 |
| 2018/0347150 | A1* | 12/2018 | Moriki | E02F 9/2004 |

FOREIGN PATENT DOCUMENTS

| | | | | |
|---|---|---|---|---|
| JP | 2013-217137 | | 10/2013 | |
| JP | 2015-168973 | | 9/2015 | |
| JP | 2016-003442 | | 1/2016 | |
| WO | 2014/167718 | | 10/2014 | |
| WO | WO-2017094627 | A1 * | 6/2017 | E02F 3/36 |

* cited by examiner

SHOVEL AND CONTROLLER FOR SHOVEL

CROSS-REFERENCE TO RELATED APPLICATIONS

This application is a continuation application filed under 35 U.S.C. 111 (a) claiming benefit under 35 U.S.C. 120 and 365 (c) of PCT International Application No. PCT/JP2019/044784, filed on Nov. 14, 2019, and designating the U.S., which claims priority to Japanese Patent Application No. 2018-214165 filed on Nov. 14, 2018. The entire contents of the foregoing applications are incorporated herein by reference.

BACKGROUND

Technical Field

The present disclosure relates to a shovel and the like.

Description of Related Art

For example, a shovel that controls excavation by moving the teeth end of the bucket along a planned surface is known.

SUMMARY

According to an aspect of the present disclosure, provided is a shovel including:

a lower traveling body;

an upper turning body turnably mounted on the lower traveling body;

an attachment attached to the upper turning body;

a plurality of actuators including a first actuator and a second actuator and configured to drive the attachment and the upper turning body; and a processor configured to control an operation of the second actuator in accordance with an operation of the first actuator, wherein the processor is configured to, in response to determining that a predetermined condition on the operation of the second actuator is satisfied, control the operation of the first actuator such that the operation of the first actuator corresponds to the operation of the second actuator.

According to an aspect of the present disclosure, provided is a controller for a shovel, the shovel including a lower traveling body, an upper turning body turnably mounted on the lower traveling body, an attachment attached to the upper turning body, and a plurality of actuators including a first actuator and a second actuator and configured to drive the attachment and the upper turning body, the controller comprising a processor configured to:

control an operation of the second actuator in accordance with an operation of the first actuator; and in response to determining that a predetermined condition on the operation of the second actuator is satisfied, control the operation of the first actuator such that the operation of the first actuator corresponds to the operation of the second actuator.

EMBODIMENT OF THE INVENTION

For example, a shovel that controls excavation by moving the teeth end of the bucket along the planned surface is known.

However, the boom and the like are desired to be moved in accordance with movement of the arm according to operator's arm operation. For this reason, for example, when the movement speed of the boom required to catch up with the movement of the arm corresponding to the operator's operation quantity of the arm exceeds a limitation determined in advance, the end of the teeth of the bucket may move beyond the planned surface.

Accordingly, in view of the above problem, it is desired to provide a technique capable of appropriately moving the tip portion of the attachment of the shovel along the planned surface.

Hereinafter, modes for carrying out the invention are described with reference to the drawings.

[Overview of Shovel]

First, an overview of the shovel 100 according to the present embodiment is explained with reference to FIG. 1 and FIG. 2.

Figure 1:
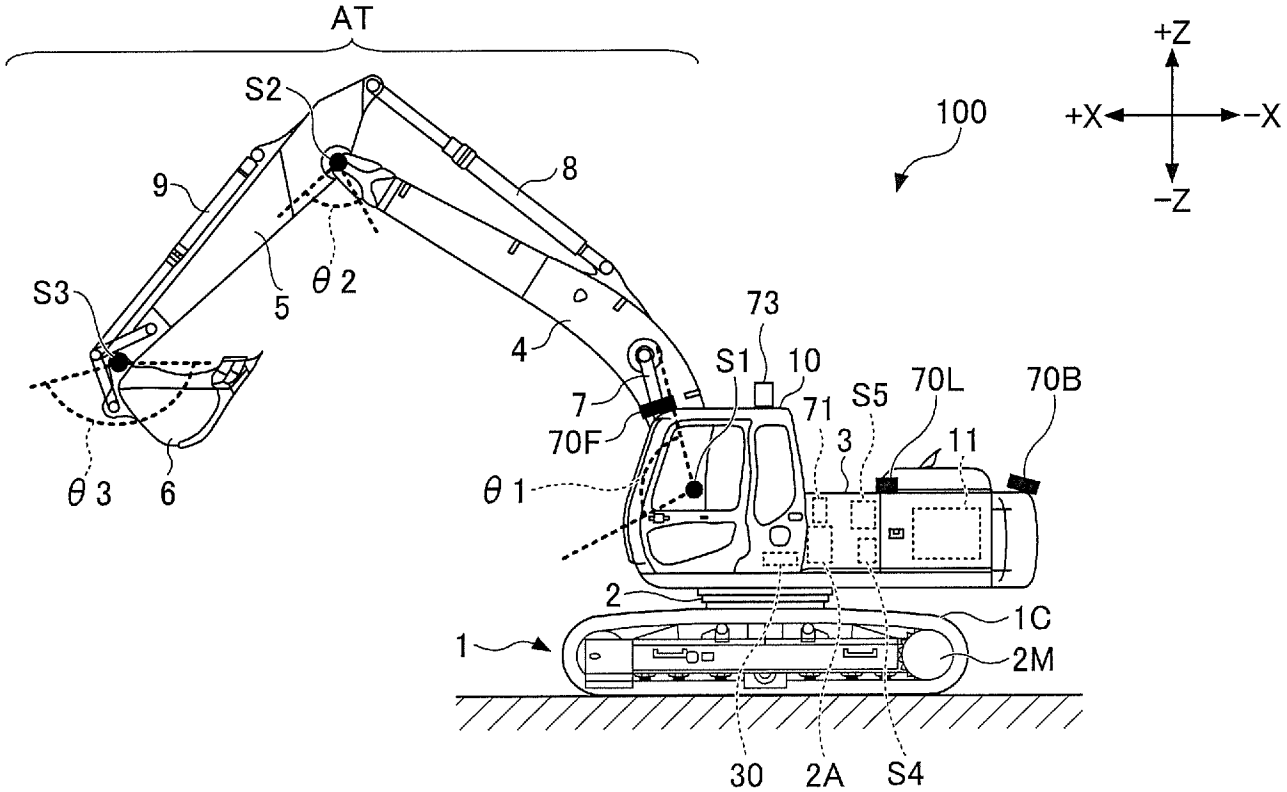
FIG. 1 is a side view illustrating a shovel.
Figure 2:
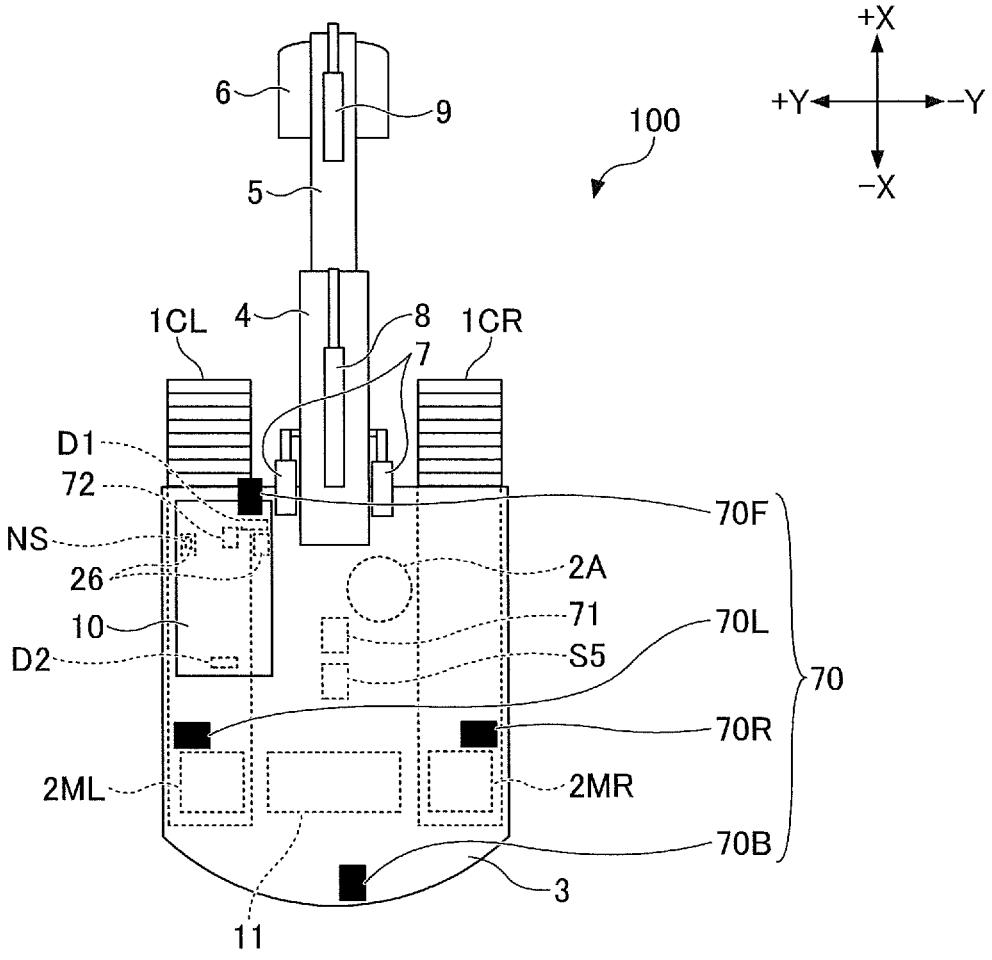
FIG. 2 is a plan view illustrating the shovel.

FIG. 1 and FIG. 2 are a side view and a plan view, respectively, of the shovel 100 according to the present embodiment.

The shovel 100 according to the present embodiment includes a lower traveling body 1, an upper turning body 3 turnably mounted on the lower traveling body 1 with a turning mechanism 2, a boom 4, an arm 5, a bucket 6, and a cab 10. The boom 4, the arm 5, and the bucket 6 constitute an attachment AT.

The lower traveling body 1 includes, for example, a pair of right and left crawlers 1C, i.e., a left crawler 1CL and a right crawler 1CR, as explained later. With the lower traveling body 1, the left crawler 1CL and the right crawler 1CR are hydraulically driven by traveling hydraulic motors 2M (2ML, 2MR) to cause the shovel 100 to travel.

The upper turning body 3 is driven by a turning hydraulic motor 2A (an example of a turning actuator) to turn with respect to the lower traveling body 1.

The boom 4 is pivotally attached to the front center of the upper turning body 3 to be able to vertically pivot. The arm 5 is pivotally attached to the end of the boom 4 to be able to pivot vertically. The bucket 6 is pivotally attached to the end of the arm 5 to be able to pivot vertically. The boom 4, the arm 5, and the bucket 6 are hydraulically driven by a boom cylinder 7, an arm cylinder 8, and a bucket cylinder 9, respectively, serving as hydraulic actuators.

The bucket 6 is an example of an end attachment. According to the content of task and the like, instead of the bucket 6, other end attachments such as, for example, a slope finishing bucket, a dredging bucket, a breaker, and the like may be attached to the end of the arm 5.

The cab 10 is an operation room in which the operator rides, and is mounted on the front left of the upper turning body 3.

The shovel 100 drives operation elements (driven elements) such as the lower traveling body 1, the upper turning body 3, the boom 4, the arm 5, the bucket 6, and the like according to the operation performed by the operator who rides the cab 10.

Instead of or in addition to the configuration for enabling the operator in the cab 10 to operate the shovel 100, the shovel 100 may be configured to be able to be remotely operated by an operator of a predetermined external device (for example, a support device 200 and a management device 300 explained later). In this case, for example, the shovel 100 transmits, to the external device, image information (a captured image) that is output from a spatial recognition device 70 explained later. Likewise, various kinds of information images (for example, various kinds of setting screens and the like) displayed on a display device D1 of the shovel 100 explained later may be displayed on a display device provided on the external device. Accordingly, for example, while the operator sees the content displayed on the display device provided on the external device, the operator can remotely operate the shovel 100. The shovel 100 may drive operation elements of the lower traveling body 1, the upper turning body 3, the boom 4, the arm 5, the bucket 6, and the like by activating the actuators in accordance with a remote operation signal representing the content of the remote operation received from the external device. When the shovel 100 is remotely operated, the cab 10 may be unmanned. In the following explanation, it is assumed that the operator's operations include an operation performed by the operator in the cab 10 with the operating apparatus 26 or a remote operation performed by the operator with the external device, or include both of them.

Also, the shovel 100 may automatically activate hydraulic actuators regardless of the content of the operator's operations. In this case, the shovel 100 achieves a function for automatically activating at least some of the operation elements of the lower traveling body 1, the upper turning body 3, the boom 4, the arm 5, the bucket 6, and the like (hereinafter referred to as an "automatic driving function" or a "machine control function").

The automatic drive function includes a function for automatically activating operation elements (hydraulic actuators) other than the operation element (hydraulic actuator) that is to be operated according to the operator's operations with the operating apparatus 26 and the remote operations (what is termed as a "semi-automatic drive function"). Also, the automatic drive function may include a function for automatically operating at least some of the multiple driven elements (hydraulic actuators) under the assumption that the operator's operations with the operating apparatus 26 and the remote operation are not performed (what is termed as a "full-automatic drive function"). In the shovel 100, in the case where the full-automatic drive function is activated, the cab 10 may be unmanned. Also, the automatic drive function may include a function ("gesture operation function") in which the shovel 100 recognizes a gesture of a person such as a worker and the like around the shovel 100, and according to the content of the recognized gesture, at least some of the multiple operation elements (hydraulic actuators) are automatically operated. Also, the semi-automatic drive function, the full-automatic drive function, and the gesture operation function may include an aspect in which operation inputs for operation elements (hydraulic actuators) that are to be automatically driven are automatically determined according to a rule defined in advance. Also, the semi-automatic drive function, the full-automatic drive function, and the gesture operation function may include an aspect in which the shovel 100 makes autonomously various kinds of determinations, and may, according to the determination result, autonomously determine operation inputs for driven elements (hydraulic actuators) that are to be automatically driven (what is termed as an "autonomous driving function").

[Configuration of Shovel]

Subsequently, the configuration of the shovel 100 is explained with reference to not only FIG. 1 and FIG. 2 but also FIG. 3 and FIG. 4A to FIG. 4D.

Figure 3:
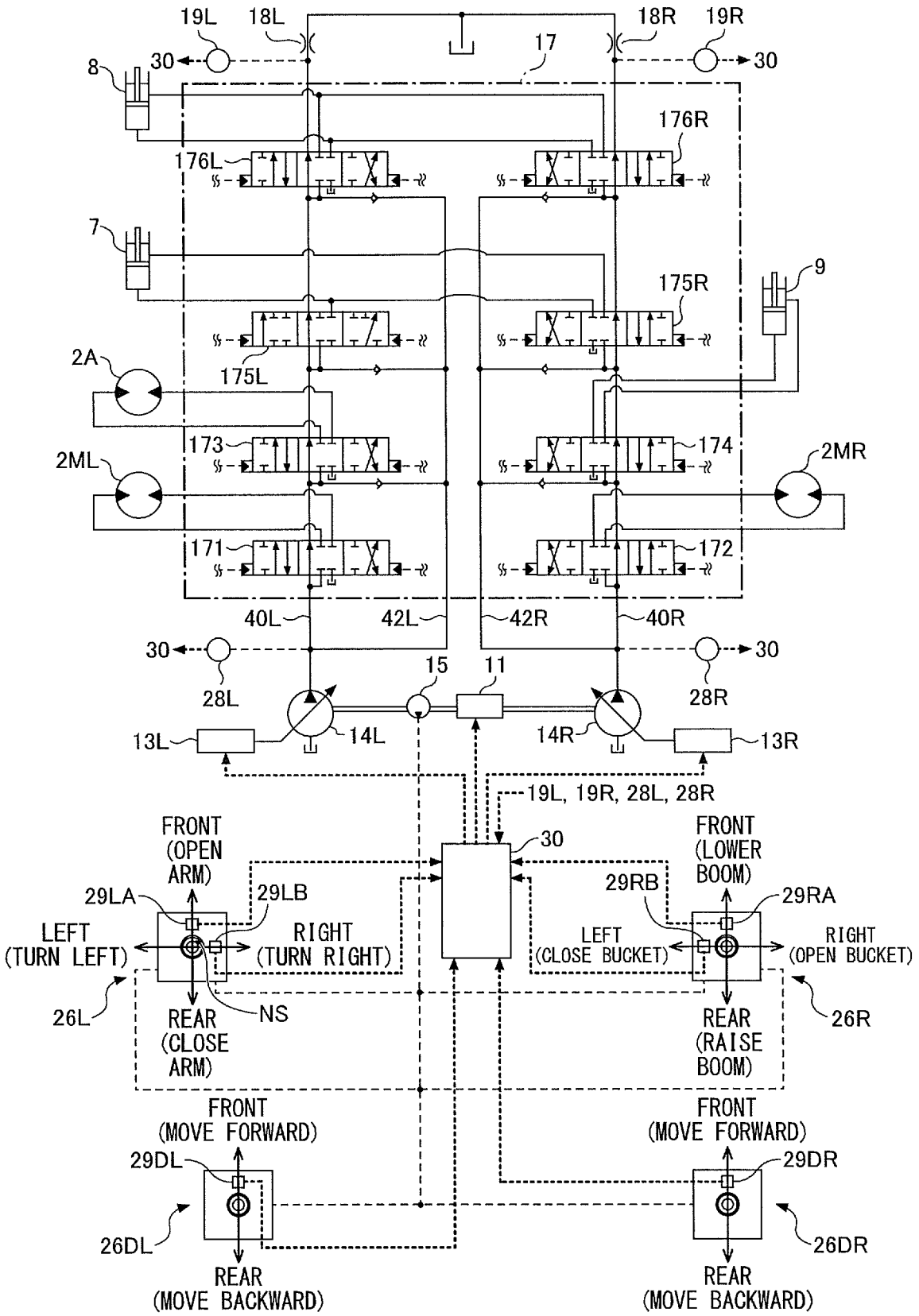
FIG. 3 is a drawing illustrating an example of configuration of a hydraulic system of the shovel.

FIG. 3 is a drawing for explaining an example of configuration of the shovel 100 according to the present embodiment. FIG. 4A to FIG. 4D are drawings illustrating examples of portions constituting the operation system for operating the attachment AT and the upper turning body 3 in the hydraulic system of the shovel 100 according to the present embodiment. Specifically, FIG. 4A to FIG. 4D are drawings illustrating examples of portions constituting the operation system for operating the arm 5, the boom 4, the bucket 6, and the upper turning body 3, respectively.

The hydraulic system of the shovel 100 according to the present embodiment includes an engine 11, a regulator 13, a main pump 14, a pilot pump 15, a control valve 17, an operating apparatus 26, a discharge pressure sensor 28, an operation pressure sensor 29, and a controller 30. As described above, the hydraulic system of the shovel 100 according to the present embodiment includes the hydraulic actuators such as the traveling hydraulic motors 2ML, 2MR, the turning hydraulic motor 2A, the boom cylinder 7, the arm cylinder 8, the bucket cylinder 9, and the like that hydraulically drive the lower traveling body 1, the upper turning body 3, the boom 4, the arm 5, and the bucket 6, respectively.

The engine 11 is a main power source in the hydraulic drive system, and is mounted on the rear part of the upper turning body 3, for example. Specifically, under direct or indirect control by the controller 30, the engine 11 rotates constantly at a pre-set target rotational speed, and drives the main pump 14 and the pilot pump 15. The engine 11 is, for example, a diesel engine using light oil as fuel.

The regulator 13 controls the amount of discharge of the main pump 14. For example, the regulator 13 adjusts the angle ("tilt angle") of a swashplate of the main pump 14 according to a control command received from the controller 30. The regulator 13 includes regulators 13L, 13R corresponding to main pumps 14L, 14R, respectively, explained later.

Like the engine 11, the main pump 14 is mounted, for example, on the rear part of the upper turning body 3, and the main pump 14 is driven by the engine 11 to supply hydraulic oil to the control valve 17 via a high-pressure hydraulic line as described above. For example, the main pump 14 is a variable displacement hydraulic pump, in which the regulator 13 controls the tilt angle of the swashplate to adjust the stroke length of a piston under the control performed by the controller 30 as described above, so that the discharge flowrate (discharge pressure) can be controlled. For example, the main pump 14 includes the main pumps 14L, 14R.

The pilot pump 15 is installed, for example, on the rear part of the upper turning body 3, and applies a pilot pressure to the operating apparatus 26 via a pilot line. For example, the pilot pump 15 is a fixed displacement hydraulic pump, and is driven by the engine 11, as described above.

The control valve 17 is a hydraulic controller that is installed, for example, at the center of the upper turning body 3, and that controls the hydraulic drive system in accordance with an operator's operation with the operating apparatus 26 or in accordance with the remote operation. As described above, the control valve 17 is connected to the main pump 14 via the high-pressure hydraulic line, and in accordance with the operation with the operating apparatus 26 and the remote operation, the control valve. 17 selectively provides the hydraulic oil supplied from the main pump 14 to the hydraulic actuators (the traveling hydraulic motors 2ML, 2MR, the turning hydraulic motor 2A, the boom cylinder 7, arm cylinder 8, and the bucket cylinder 9). Specifically, the control valve 17 includes control valves 171 to 176 controlling the flowrates and the directions of hydraulic oil supplied from the main pump 14 to the hydraulic actuators. The control valve 171 corresponds to the traveling hydraulic motor 2ML. The control valve 172 corresponds to the traveling hydraulic motor 2MR. The control valve 173 corresponds to the turning hydraulic motor 2A. The control valve 174 corresponds to the bucket cylinder 9. The control valve 175 corresponds to the boom cylinder 7, and includes control valves 175L, 175R. The control valve 176 corresponds to the arm cylinder 8, and includes control valves 176L, 176R.

The operating apparatus 26 is provided near the operator's seat of the cab 10, and is operation input means allowing the operator to operate the operation elements (the lower traveling body 1, the upper turning body 3, the boom 4, the arm 5, the bucket 6, and the like). In other words, the operating apparatus 26 is operation input means for allowing the operator to operate the operation elements for driving the hydraulic actuators (i.e., the traveling hydraulic motors 2ML, 2MR, the turning hydraulic motor 2A, the boom cylinder 7, the arm cylinder 8, the bucket cylinder 9, and the like).

As illustrated in FIG. 3 and FIG. 4A to FIG. 4D, the operating apparatus 26 is of a hydraulic pilot type. The operating apparatus 26 is connected to the control valve. 17 directly via a secondary-side pilot line or indirectly via a shuttle valve 32 explained later provided in the secondary-side pilot line. Accordingly, the control valve 17 receives pilot pressures according to the operation state of the operating apparatus 26 for operating the lower traveling body 1, the upper turning body 3, the boom 4, the arm 5, the bucket 6, and the like. This enables the control valve 17 can drive the hydraulic actuators according to the operation state of the operating apparatus 26. The operating apparatus 26 includes a left operation lever 26L and a right operation lever 26R for operating the attachment AT, i.e., the boom 4 (the boom cylinder 7), the arm 5 (the arm cylinder 8), the bucket 6 (the bucket cylinder 9), and the upper turning body 3. The operating apparatus 26 includes a traveling lever 26D for operating the lower traveling body 1. The traveling lever 26D includes a left traveling lever 26DL for operating the left crawler 1CL and a right traveling lever 26DR for operating the right crawler 1CR.

The left operation lever 26L is used for turning operation of the upper turning body 3 and for operation of the arm 5. When the left operation lever 26L is operated in the front-and-rear direction as seen from the operator in the cab 10 (i.e., the longitudinal direction of the upper turning body 3), the left operation lever 26L uses hydraulic oil discharged from the pilot pump 15 to output a control pressure (a pilot pressure) according to the lever operation quantity to the secondary side pilot line. When the left operation lever 26L is operated in the right-and-left direction as seen from the operator in the cab 10 (i.e., the lateral direction of the upper turning body 3), the left operation lever 26L uses hydraulic oil discharged from the pilot pump 15 to output a control pressure (a pilot pressure) according to the lever operation quantity to the secondary side pilot line.

The right operation lever 26R is used for operating the boom 4 and for operating the bucket 6. When the right operation lever 26R is operated in the front-and-rear direction as seen from the operator in the cab 10 (i.e., the longitudinal direction of the upper turning body 3), the right operation lever 26R uses hydraulic oil discharged from the pilot pump 15 to output a control pressure (a pilot pressure) according to the lever operation quantity to the secondary side pilot line. When the right operation lever 26R is operated in the lateral direction, the right operation lever 26R uses hydraulic oil discharged from the pilot pump 15 to output a control pressure (a pilot pressure) according to the lever operation quantity to the secondary side pilot line.

As described above, the left traveling lever 26DL is used for operation of the left crawler 1CL, and may be configured to operate in conjunction with a left traveling pedal, not illustrated. When the left traveling lever 26DL is operated in the front-and-rear direction as seen from the operator in the cab 10 (i.e., the longitudinal direction of the upper turning body 3), the left traveling lever 26DL uses hydraulic oil discharged from the pilot pump 15 to output a control pressure (a pilot pressure) according to the lever operation quantity to the secondary side pilot line. The secondary side pilot lines corresponding to the operations in the forward direction and the backward direction of the left traveling lever 26DL are directly connected to the corresponding pilot ports of the control valve 171. Accordingly, at a spool position of the control valve 171 for driving the traveling hydraulic motor 2ML, an operation input to the left traveling lever 26DL is reflected.

As described above, the right traveling lever 26DR is used for operating the right crawler 1CR, and may be configured to operate in conjunction with a right traveling pedal, not illustrated. When the right traveling lever 26DR is operated in the front-and-rear direction as seen from the operator in the cab 10 (i.e., the longitudinal direction of the upper turning body 3), the right traveling lever 26DR uses hydraulic oil discharged from the pilot pump 15 to output a control pressure (a pilot pressure) according to the lever operation quantity to the secondary side pilot line. The secondary side pilot lines corresponding to the operations in the forward direction and the backward direction of the right traveling lever 26DR are directly connected to the corresponding pilot ports of the control valve 172. Accordingly, at a spool position of the control valve 172 for driving the traveling hydraulic motor 2MR, an operation input to the right traveling lever 26DR is reflected.

Also, the operating apparatus 26 (the left operation lever 26L, the right operation lever 26R, the left traveling lever 26DL, and the right traveling lever 26DR) does not have to be a hydraulic pilot type for outputting a pilot pressure, and may be an electric type for outputting an electric signal (hereinafter referred to as an "operation signal"). In this case, the controller 30 receives an electric signal (an operation signal) from the operating apparatus 26, and the controller 30 controls the control valves 171 to 176 of the control valve 17 in accordance with the received electric signal to achieve operations of various hydraulic actuators according to the operation input to the operating apparatus 26. For example, the control valves 171 to 176 in the control valve 17 may be electromagnetic solenoid type spool valves driven in response to commands given by the controller 30. For example, between the pilot pump 15 and the pilot ports of the control valves 171 to 176, hydraulic control valves (hereinafter referred to as an "operational control valves") operating in response to electric signals given by the controller 30 may be provided. For example, the operational control valve may be a proportional valve 31, and the shuttle valve 32 is omitted. In this case, when manual operation is performed with an electric-type operating apparatus 26, the controller 30 controls the electromagnetic valve to increase or decrease the pump accordance an pressure in with electric signal corresponding to the amount of operation (for example, the amount of operation of the lever), so that the controller 30 can operate the control valves 171 to 176 according to the operation input to the operating apparatus 26. In the following explanation, it is assumed that the operational control valve is the proportional valve 31.

The discharge pressure sensor 28 detects the discharge pressure of the main pump 14. A detection signal corresponding to the discharge pressure detected by the discharge pressure sensor 28 is input to the controller 30. The discharge pressure sensor 28 includes discharge pressure sensors 28L, 28R for detecting the discharge pressures of the main pumps 14L, 14R, respectively.

The operation pressure sensor 29 detects the secondary-side pump pressure of the operating apparatus 26, i.e., the pump pressure corresponding to the operation state of the operating apparatus 26 for each operation element (i.e., a hydraulic actuator). The detection signal of the pump pressure corresponding to the operation state of the operating apparatus 26 detected by the operation pressure sensor 29 for operating the lower traveling body 1, the upper turning body 3, the boom 4, the arm 5, the bucket 6, and the like is input to the controller 30. The operation pressure sensor 29 includes operation pressure sensors 29LA, 29LB, 29RA, 29RB, 29DL, and 29DR.

The operation pressure sensor 29LA detects, as a pressure of hydraulic oil (hereinafter referred to as an "operation pressure") in the secondary side pilot line of the left operation lever 26L, an operator's operation input to the left operation lever 26L in the longitudinal direction (for example, an operation direction and an operation quantity).

The operation pressure sensor 29LB detects, as an operation pressure in the secondary side pilot line of the left operation lever 26L, an operator's operation input to the left operation lever 26L in the lateral direction (for example, an operation direction and an operation quantity).

The operation pressure sensor 29RA detects, as an operation pressure in the secondary side pilot line of the right operation lever 26R, an operator's operation input to the right operation lever 26R in the longitudinal direction (for example, an operation direction and an operation quantity).

The operation pressure sensor 29RB detects, as an operation pressure in the secondary side pilot line of the right operation lever 26R, an operator's operation input to the right operation lever 26R in the lateral direction (for example, an operation direction and an operation quantity).

The operation pressure sensor 29DL detects, as an operation pressure in the secondary side pilot line of the left traveling lever 26DL, an operator's operation input to the left traveling lever 26DL in the longitudinal direction (for example, an operation direction and an operation quantity).

The operation pressure sensor 29DR detects, as an operation pressure in the secondary side pilot line of the right traveling lever 26DR, an operator's operation input to the right traveling lever 26DR in the longitudinal direction (for example, an operation direction and an operation quantity).

Alternatively, the operation input to the operating apparatus 26 (the left operation lever 26L, the right operation lever 26R, the left traveling lever 26DL, and the right traveling lever 26DR) may be detected by sensors other than the operation pressure sensor 29 (for example, potentiometers and the like attached to the right operation lever 26R, the left traveling lever 26DL, and the right traveling lever 26DR).

For example, the controller 30 (an example of a control device) is provided in the cab 10 to drive and control the shovel 100. The functions of the controller 30 may be achieved by any hardware or a combination of hardware and software. For example, the controller 30 is mainly constituted by a microcomputer including a central processing unit (CPU), a memory device (also referred to as a main storage device) such as a random access memory (RAM), a non-volatile auxiliary storage device such as a read-only memory (ROM), an interface device for various kinds of inputs and outputs, and the like. The controller 30 achieves various functions by causing the CPU to execute various programs installed on the non-volatile auxiliary storage device.

Some of the functions of the controller 30 may be achieved by other controllers (control devices). Specifically, the functions of the controller 30 may be achieved as being distributed to multiple controllers.

In this case, as illustrated in FIG. 3, in the hydraulic system portion of the drive system for driving the hydraulic actuator in the hydraulic system of the shovel 100, hydraulic oil is circulated from the main pumps 14L, 14R driven by the engine 11 to the hydraulic oil tank through center bypass pipelines 40L, 40R and parallel pipelines 42L, 42R.

The center bypass pipeline 40L starts from the main pump 14L, passes through the control valves 171, 173, 175L, 176L arranged in the control valve 17 in order, and reaches the hydraulic oil tank.

The center bypass pipeline 40R starts from the main pump 14R, passes through the control valves 172, 174, 175R, 176R arranged in the control valve 17 in order, and reaches the hydraulic oil tank.

The control valve 171 is a spool valve that supplies hydraulic oil discharged from the main pump 14L to the traveling hydraulic motor 2ML and that discharges hydraulic oil discharged from the traveling hydraulic motor 2ML to the hydraulic oil tank.

The control valve 172 is a spool valve that supplies hydraulic oil discharged from the main pump 14R to the traveling hydraulic motor 2MR and that discharges hydraulic oil discharged from the traveling hydraulic motor 2MR to the hydraulic oil tank.

The control valve 173 is a spool valve that supplies hydraulic oil discharged from the main pump 14L to the turning hydraulic motor 2A and that discharges hydraulic oil discharged from the turning hydraulic motor 2A to the hydraulic oil tank.

The control valve 174 is a spool valve that supplies hydraulic oil discharged from the main pump 14R to the bucket cylinder 9 and that discharges hydraulic oil in the bucket cylinder 9 to the hydraulic oil tank.

The control valves 175L, 175R are spool valves that supply hydraulic oil discharged from the main pumps 14L, 14R, respectively, to the boom cylinder 7 and that discharge hydraulic oil in the boom cylinder 7 to the hydraulic oil tank.

The control valves 176L, 176R are spool valves that supply hydraulic oil discharged from the main pumps 14L, 14R, respectively, to the arm cylinder 8 and that discharge hydraulic oil in the arm cylinder 8 to the hydraulic oil tank.

The control valves 171, 172, 173, 174, 175L, 175R, 176L, 176R adjust the flowrates and switch the flow direction of hydraulic oil supplied to or discharged from the hydraulic actuators in accordance with the pilot pressures applied to the pilot ports.

The parallel pipeline 42L supplies hydraulic oil of the main pump 14L to the control valves 171, 173, 175L, 176L in parallel with the center bypass pipeline 40L. Specifically, on the upstream side of the control valve 171, the parallel pipeline 42L branches off from the center bypass pipeline 40L, and is configured to be able to supply hydraulic oil of the main pump 14L in parallel with the control valves 171, 173, 175L, 176R. Accordingly, in a case where any one of the control valves 171, 173, 175L limits or cuts off the flow of hydraulic oil passing through the center bypass pipeline 40L, the parallel pipeline 42L can supply hydraulic oil to a control valve further downstream.

The parallel pipeline 42R supplies the hydraulic oil of the main pump 14R to the control valves 172, 174, 175R, 176R in parallel with the center bypass pipeline 40R. Specifically, on the upstream side of the control valve 172, the parallel pipeline 42R branches from the center bypass pipeline 40R, and is configured to supply the hydraulic oil of the main pump 14R in parallel with each of the control valves 172, 174, 175R, 176R in parallel. Accordingly, in a case where any one of the control valves 172, 174, 175R limits or cuts off the flow of the hydraulic oil passing through the center bypass pipeline 40R, the parallel pipeline 42R can supply the hydraulic oil to a control valve further downstream.

The regulators 13L, 13R adjust the amounts of discharge of the main pumps 14L, 14R by adjusting the tilt angles of the swashplates of the main pumps 14L, 14R, respectively, under the control of the controller 30.

The discharge pressure sensor 28L detects the discharge pressure of the main pump 14L. A detection signal corresponding to the detected discharge pressure is input to the controller 30. This is also applicable to the discharge pressure sensor 28R. Accordingly, the controller 30 controls the regulators 13L, 13R according to the discharge pressures of the main pumps 14L, 14R.

The center bypass pipelines 40L, 40R include negative control throttles 18L, 18R between the most downstream control valves 176L, 176R and the hydraulic oil tank. The flow of hydraulic oil discharged from the main pumps 14L, 14R is limited by the negative control throttles 18L, 18R. The negative control throttles 18L, 18R generate a control pressure (hereinafter referred to as a "negative control pressure") so as to control the regulators 13L, 13R.

The negative control pressure sensors 19L, 19R detect negative control pressures. Detection signals corresponding to the detected negative control pressures are input to the controller 30.

The controller 30 may control the regulators 13L, 13R and adjust the amounts of discharge of the main pumps 14L, 14R according to the discharge pressures of the main pumps 14L, 14R detected by the discharge pressure sensors 28L, 28R. For example, the controller 30 may reduce the amount of discharges by controlling the regulator 13L according to the increase of the discharge pressure of the main pump 14L and adjusting the swashplate tilt angle of the main pump 14L. The same applies to the regulator 13R. Accordingly, the controller 30 can perform total horse power control of the main pumps 14L, 14R so that suction horsepower of the main pumps 14L, 14R expressed by a product of the discharge pressure and the amount of discharge does not exceed the output horse power of the engine 11.

Also, the controller 30 may adjust the amounts of discharges of the main pumps 14L, 14R by controlling the regulators 13L, 13R according to the negative control pressures detected by the negative control pressure sensors 19L, 19R. For example, as the negative control pressure increases, the controller 30 decreases the amounts of discharges of the main pumps 14L, 14R, and as the negative control pressure decreases, the controller 30 increases the amounts of discharges of the main pumps 14L, 14R.

Specifically, in a case where the hydraulic actuator in the shovel 100 is in a standby state (a state as illustrated in FIG. 3) in which no operation is performed, the hydraulic oil discharged from the main pumps 14L, 14R pass through the center bypass pipelines 40L, 40R to reach the negative control throttles 18L, 18R. Then, the flows of the hydraulic oils discharged from the main pumps 14L, 14R increase the negative control pressures generated at the upstream of the negative control throttles 18L, 18R. As a result, the controller 30 decreases the amounts of discharges of main pumps 14L, 14R to the allowable minimum amounts of discharges, and reduce pressure force loss (pumping loss) that occurs when the discharged hydraulic oils pass through the center bypass pipelines 40L, 40R.

Conversely, in a case where any one of the hydraulic actuators is operated by the operating apparatus 26, the hydraulic oils discharged from the main pumps 14L, 14R flow via the corresponding control valves to the operation target hydraulic actuators. Accordingly, the amount of the hydraulic oil discharged from the main pumps 14L, 14R that reaches the negative control throttles 18L, 18R decreases or disappears, so that the negative control pressure occurring at the upstream of the negative control throttles 18L, 18R decreases. As a result, the controller 30 increases the amount of discharge of the main pumps 14L, 14R, and circulates hydraulic oil sufficient for the hydraulic actuator of the operation target, so that the hydraulic actuator of the operation target can be driven reliably.

In this case, as illustrated in FIG. 3 and FIG. 4A to FIG. 4D, the hydraulic system portion for the operation system in the hydraulic system of the shovel 100 includes the pilot pump 15, the operating apparatus 26 (the left operation lever 26L, the right operation lever 26R, the left traveling lever 26DL, and the right traveling lever 26DR), the proportional valve 31, the shuttle valve 32, and a pressure reduction proportional valve 33.

The proportional valve 31 is provided in a pilot line connecting the pilot pump 15 and the shuttle valve 32, and configured to be able to change the size of area of flow (i.e., the size of a cross-sectional area in which hydraulic oil can flow). The proportional valve 31 operates in accordance with a control command received from the controller 30. Accordingly, even in a case where an operator is not operating the operating apparatus 26 (i.e., the left operation lever 26L and the right operation lever 26R), the controller 30 can provide hydraulic oil discharged from the pilot pump 15 through the proportional valve 31 and the shuttle valve 32 to the pilot ports in the corresponding control valves (i.e., the control valves 173 to 176) in the control valve 17. Therefore, the controller 30 can achieve the automatic driving function and the remote operation function of the shovel 100 by controlling the proportional valve 31. The proportional valve 31 includes proportional valves 31AL, 31AR, 31BL, 31BR, 31CL, 31CR, 31DL, 31DR.

The shuttle valve 32 includes two inlet ports and one output port, and is configured to output, from the output port, a hydraulic oil having a higher pump pressure from among the pump pressures applied to the two inlet ports. One of the two inlet ports of the shuttle valve 32 is connected to the operating apparatus 26, and the other of the two inlet ports of the shuttle valve 32 is connected to the proportional valve 31. The output port of the shuttle valve 32 is connected to the pilot port of the corresponding control valve in the control valve 17 through the pilot line. Therefore, the shuttle valve 32 can apply one of the pump pressure generated by the operating apparatus 26 and the pump pressure generated by the proportional valve 31, whichever is higher, to the pilot port of the corresponding control valve. In other words, the controller 30 outputs, from the proportional valve 31, a pump pressure higher than the secondary-side pump pressure output from the operating apparatus 26 to control the corresponding control valve without relying on the operator's operation of the operating apparatus 26, and control the operation of the lower traveling body 1, the upper turning body 3, and the attachment AT. The shuttle valve 32 includes shuttle valves 32AL, 32AR, 32BL, 32BR, 32CL, 32CR, 32DL, 32DR.

The pressure reduction proportional valve 33 is provided in a pilot line connecting the operating apparatus 26 and the shuttle valve 32. For example, the pressure reduction proportional valve 33 is configured to be able to change the size of area of flow thereof. The pressure reduction proportional valve 33 operates in accordance with a control command received from the controller 30. Accordingly, in a case where the operator is operating the operating apparatus 26 (i.e., the lever devices 26A to 26C), the controller 30 can forcibly reduce the pilot pressure that is output from the operating apparatus 26. Therefore, even in the case where the operating apparatus 26 is being operated, the controller 30 can forcibly inhibit or stop the operation of the hydraulic actuators corresponding to the operation of the operating apparatus 26. For example, even in the case where the operating apparatus 26 is being operated, the controller 30 can reduce the pilot pressure that is output from the operating apparatus 26 to a pressure lower than the pilot pressure that is output from the proportional valve 31. Accordingly, for example, regardless of the operation input to the operating apparatus 26, the controller 30 can reliably apply a desired pilot pressure to the pilot port of the control valve in the control valve 17 by controlling the proportional valve 31 and pressure reduction proportional valve 33. Therefore, for example, the controller 30 can more appropriately achieve the automatic driving function and the remote operation function of the shovel 100 by controlling not only the proportional valve 31 but also the pressure reduction proportional valve 33. As explained later, the pressure reduction proportional valve 33 includes pressure reduction proportional valves 33AL, 33AR, 33BL, 33BR, 33CL, 33CR, 33DL, 33DR.

The pressure reduction proportional valve 33 may be replaced with a switch valve. Under the control of the controller 30, the switch valve switches the pilot line between the operating apparatus 26 and the shuttle valve 32 (32AL, 32AR) into a communication state and a non-communication state.

Figure 4A:
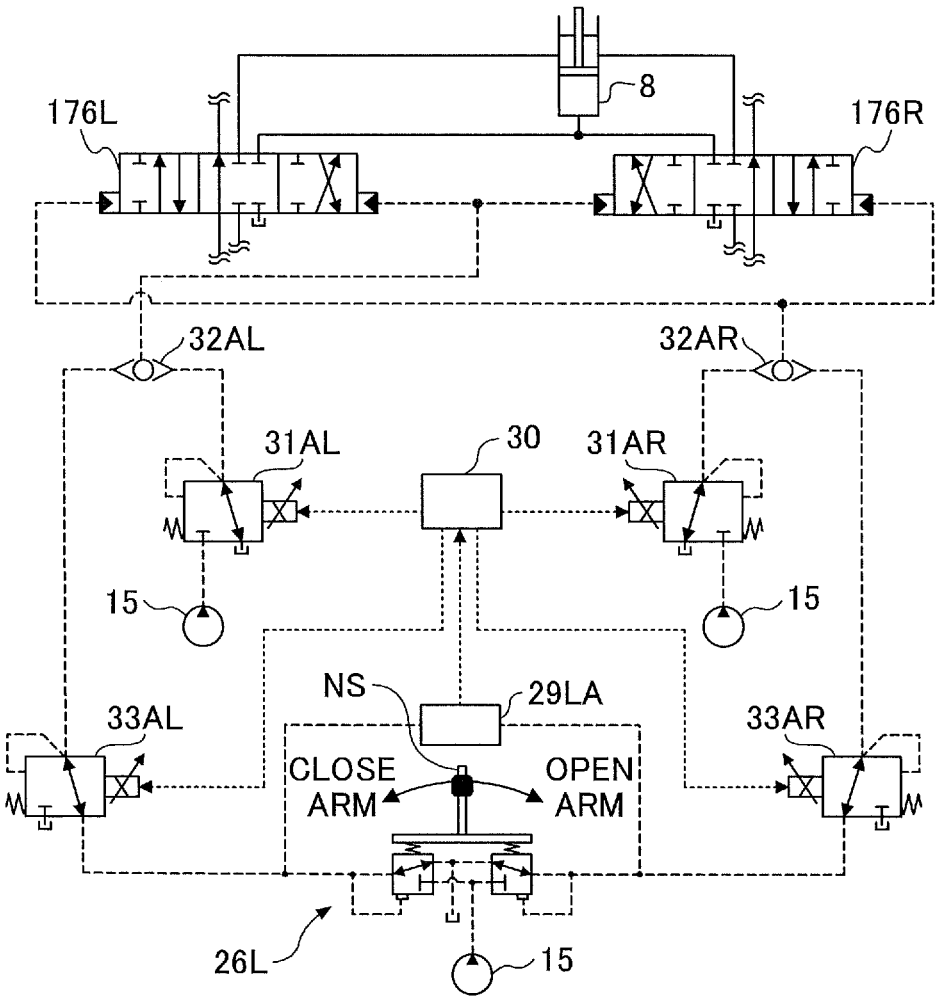
FIG. 4A is a drawing illustrating an example of a portion constituting an operation system for operating an arm in the hydraulic system of the shovel.

As illustrated in FIG. 4A, the left operation lever 26L is tilted by the operator in the longitudinal direction to operate the arm cylinder 8 corresponding to the arm 5. Specifically, in a case where the left operation lever 26L is tilted in the longitudinal direction, the operation of the arm 5 is the operation target. The left operation lever 26L uses hydraulic oil discharged from the pilot pump 15 to output, to the secondary side, a pilot pressure according to the operation input in the longitudinal direction.

The two respective inlet ports of the shuttle valve 32AL are connected to the secondary side pilot line of the left operation lever 26L corresponding to an operation in a direction to close the arm 5 (hereinafter "arm closing operation") and the secondary side pilot line of the proportional valve 31AL. The output port of the shuttle valve 32AL is connected to the pilot port at the right side of the control valve 176L and the pilot port at the left side of the control valve 176R.

The two respective inlet ports of the shuttle valve 32AR are connected to the secondary side pilot line of the left operation lever 26L corresponding to an operation in a direction to open the arm 5 (hereinafter referred to as an "arm opening operation") and the secondary side pilot line of the proportional valve 31AR. The outlet port of the shuttle valve 32AR is connected to the pilot port at the left side of the control valve 176L and the pilot port at the right side of the control valve 176R.

In other words, the left operation lever 26L applies, to the pilot ports of the control valves 176L, 176R, the pilot pressures according to the operation input in the longitudinal direction through the shuttle valves 32AL, 32AR. Specifically, in a case where the arm closing operation is performed, the left operation lever 26L outputs the pilot pressure according to the operation quantity to one of the inlet ports of the shuttle valve 32AL to apply the pilot pressure to the pilot port at the right side of the control valve 176L and the pilot port at the left side of the control valve 176R through the shuttle valve 32AL. In a case where the arm opening operation is performed, the left operation lever 26L outputs the pilot pressure according to the operation quantity to one of the inlet ports of the shuttle valve 32AR to apply the pilot pressure to the pilot port at the left side of the control valve 176L and the pilot port at the right side of the control valve 176R through the shuttle valve 32AR.

The proportional valve 31AL operates according to a control current received from the controller 30. Specifically, the proportional valve 31AL uses hydraulic oil discharged from the pilot pump 15 to output a pilot pressure according to a control current received from the controller 30 to the other of the pilot ports of the shuttle valve 32AL. Accordingly, the proportional valve 31AL can adjust the pilot pressures applied to the pilot port at the right side of the control valve 176L and the pilot port at the left side of the control valve 176R through the shuttle valve 32AL.

The proportional valve 31AR operates according to a control current received from the controller 30. Specifically, the proportional valve 31AR uses hydraulic oil discharged from the pilot pump 15 to output a pilot pressure according to a control current received from the controller 30 to the other of the pilot ports of the shuttle valve 32AR. Accordingly, the proportional valve 31AR can adjust the pilot pressure applied to the pilot port at the left side of the control valve 176L and the pilot port at the right side of the control valve 176R through the shuttle valve 32AR.

In other words, without relying on the operation state of the left operation lever 26L, the proportional valves 31AL, 31AR can adjust the pilot pressures that are output at the secondary side, so that the control valves 176L, 176R can be stopped at any given valve position.

The pressure reduction proportional valve 33AL operates according to a control current received from the controller 30. Specifically, in a case where a control current is not received from the controller 30, the pressure reduction proportional valve 33AL outputs, to the secondary side, the pilot pressure corresponding to the arm closing operation of the left operation lever 26L without change. Conversely, in a case where a control current is received from the controller 30, the pressure reduction proportional valve 33AL reduces, to such a degree according to the control current, the pilot pressure in the secondary side pilot line corresponding to the arm closing operation of the left operation lever 26L, and outputs the reduced pilot pressure to one of the inlet ports of the shuttle valve 32AL. Accordingly, even in a case where the arm closing operation is performed with the left operation lever 26L, the pressure reduction proportional valve 33AL can forcibly inhibit or stop, as necessary, the operation of arm cylinder the 8 corresponding to the arm closing operation. Also, even in a case where the arm closing operation is performed with the left operation lever 26L, the pressure reduction proportional valve 33AL can reduce the pilot pressure applied to one of the inlet ports of the shuttle valve 32AL to a pressure less than the pilot pressure applied to the other of the inlet ports of the shuttle valve 32AL from the proportional valve 31AL. Therefore, the controller 30 can control the proportional valve 31AL and the pressure reduction proportional valve 33AL and reliably apply a desired pilot pressure to the arm closing-side pilot ports of the control valves 176L, 176R.

The pressure reduction proportional valve 33AR operates according to a control current received from the controller 30. Specifically, in a case where a control current is not received from the controller 30, the pressure reduction proportional valve 33AR outputs, to the secondary side, the pilot pressure corresponding to the arm opening operation of the left operation lever 26L without change. Conversely, in a case where a control current is received from the controller 30, the pressure reduction proportional valve 33AR reduces, to such a degree according to the control current, the pilot pressure in the secondary side pilot line corresponding to the arm opening operation of the left operation lever 26L, and outputs the reduced pilot pressure to one of the inlet ports of the shuttle valve 32AR. Accordingly, even in a case where an arm opening operation is performed with the left operation lever 26L, the pressure reduction proportional valve 33AR can forcibly inhibit or stop, as necessary, the of the operation arm cylinder 8 corresponding to the arm opening operation. Also, even in a case where an arm opening operation is performed with the left operation lever 26L, the pressure reduction proportional valve 33AR can reduce the pilot pressure applied to one of the inlet ports of the shuttle valve 32AR to a pressure less than the pilot pressure applied to the other of the inlet ports of the shuttle valve 32AR from the proportional valve 31AR. Therefore, the controller 30 can control the proportional valve 31AR and the pressure reduction proportional valve 33AR and reliably apply a desired pilot pressure to the arm opening-side pilot ports of the control valves 176L, 176R.

In this manner, the pressure reduction proportional valves 33AL, 33AR can forcibly inhibit or stop the operation of the arm cylinder 8 corresponding to the operation state of the left operation lever 26L in the longitudinal direction. The pressure reduction proportional valves 33AL, 33AR can reduce the pilot pressure applied to one of the inlet ports of the shuttle valves 32AL, 32AR to provide support so that the pilot pressures of the proportional valves 31AL, 31AR, respectively, are reliably applied to the pilot ports of the control valves 176L, 176R through the shuttle valves 32AL, 32AR, respectively.

Instead of controlling the pressure reduction proportional valve 33AL, the controller 30 may forcibly inhibit or stop the operation of the arm cylinder 8 corresponding to the arm closing operation of the left operation lever 26L by controlling the proportional valve 31AR. For example, in a case where the arm closing operation is performed with the left operation lever 26L, the controller 30 can control the proportional valve 31AR to apply a predetermined pilot pressure to the arm opening-side pilot ports of the control valves 176L, 176R through the shuttle valve 32AR from the proportional valve 31AR. Accordingly, the pilot pressures are applied to the arm opening-side pilot ports of the control valves 176L, 176R against the pilot pressure applied to the arm closing-side pilot ports of the control valves 176L, 176R from the left operation lever 26L through the shuttle valve 32AL. Therefore, the controller 30 can forcibly inhibit or stop the operation of the arm cylinder 8 corresponding to the arm closing operation of the left operation lever 26L by forcibly bringing the control valves 176L, 176R to the neutral position. Likewise, instead of controlling the pressure reduction proportional valve 33AR, the controller 30 may forcibly inhibit or stop the operation of the arm cylinder 8 corresponding to the arm opening operation of the left operation lever 26L by controlling the proportional valve 31AL.

Also, each of the pressure reduction proportional valves 33AL, 33AR may be replaced with a switch valve. Similarly, each of the pressure reduction proportional valves 33BL, 33BR, 33CL, 33CR, 33DL, 33DR may also be replaced with a switch valve.

A switch valve corresponding to the pressure reduction proportional valve 33AL is provided in the pilot line between the secondary side port of the left operation lever 26L corresponding to the arm closing operation and the shuttle valve 32AL, and switches the pilot line into either a communication state or a non-communication state according to a control command received from the controller 30. For example, the switch valve may be a normally-open type switch valve which, in a normal state, maintains the pilot line in the communication state, and causes the pilot line to be in the non-communication state control received according to a command from the controller 30 to discharge, to the hydraulic oil tank, hydraulic oil corresponding to the arm closing operation that is output from the left operation lever 26L.

A switch valve corresponding to the pressure reduction proportional valve 33AR is provided in the pilot line between the secondary side port of the left operation lever 26L corresponding to the arm opening operation and the shuttle valve 32AR, and switches the pilot line into either a communication state or a non-communication state according command received from the to a control controller 30. For example, the switch valve may be a normally-open type switch valve which, in a normal state, maintains the pilot line in the communication state, and causes the pilot line to be in the non-communication state according to a control command received from the controller 30 to discharge, to the hydraulic oil tank, hydraulic oil corresponding to the arm opening operation that is output from the left operation lever 26L.

Therefore, the switch valve can prevent the shuttle valves 32AL, 32AR from receiving the pilot pressure corresponding to the operation of the arm 5 applied by the left operation lever 26L.

The operation pressure sensor 29LA detects, as a pressure (an operation pressure), an operator's operation input to the left operation lever 26L in the longitudinal direction, and the controller 30 receives a detection signal corresponding to the detected pressure. Accordingly, the controller 30 can ascertain the operation input to the left operation lever 26L in the longitudinal direction. Examples of operation inputs to the left operation lever 26L in the longitudinal direction that are to be detected may include an operation direction, an operation quantity (an operation angle), and the like. The above is also applicable to operation inputs to the left operation lever 26L in the lateral direction and operation inputs to the right operation lever 26R in the longitudinal direction and the lateral direction.

Independently from the arm closing operation performed by the operator with the left operation lever 26L, the controller 30 can supply hydraulic oil discharged from the pilot pump 15 to the pilot port at the right side of the control valve 176L and the pilot port at the left side of the control valve 176R through the proportional valve 31AL and the shuttle valve 32AL. Independently from the arm opening operation performed by the operator with the left operation lever 26L, the controller 30 supplies hydraulic oil discharged from the pilot pump 15 to the pilot port at the left side of the control valve 176L and the pilot port at the right side of the control valve 176R through the proportional valve 31AR and the shuttle valve 32AR. Specifically, the controller 30 can achieve the automatic driving function, the remote operation function, and the shovel 100 by automatically the like of controlling the opening and closing operation of the arm 5.

In addition, as described above, the controller 30 controls the pressure reduction proportional valves 33AL, 33AR and the switch valves, so that the pilot pressures applied to the shuttle valves 32AL, 32AR from the secondary side pilot line of the left operation lever 26L corresponding to the operation of the arm 5 can be relatively reduced. Accordingly, the controller 30 can apply a pilot pressure, which is smaller than the pilot pressure corresponding to an operation for operating the arm 5 with the left operation lever 26L, to the corresponding pilot ports of the control valves 176L, 176R through the proportional valves 31AL, 31AR and shuttle valves 32AL, 32AR. Therefore, for example, the controller 30 can slow down the movement speed, the movement acceleration, and the like of the arm 5 with respect to an operation quantity of an operation for operating the arm 5 with the left operation lever 26L.

Figure 4B:
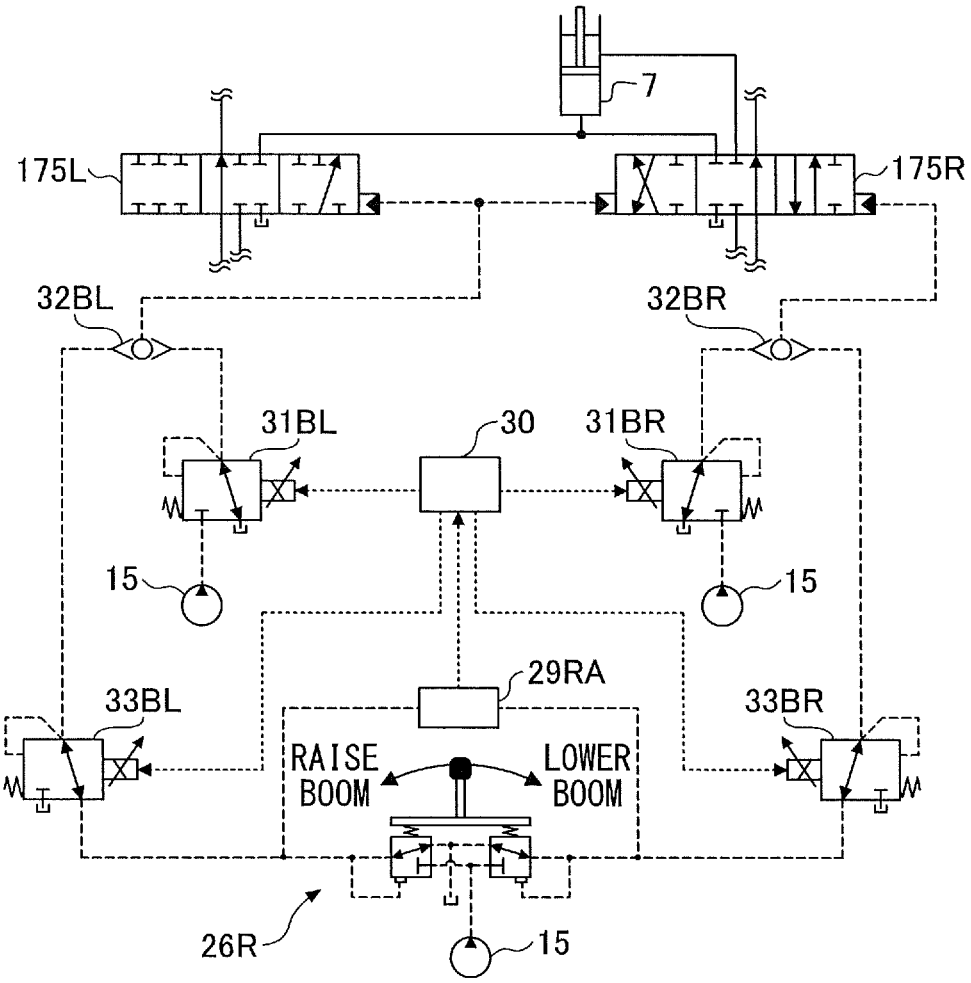
FIG. 4B is a drawing illustrating an example of a portion constituting the operation system for operating a boom in the hydraulic system of the shovel.

For example, as illustrated in FIG. 4B, the right operation lever 26R is tilted by the operator in the longitudinal direction to operate the boom cylinder 7 corresponding to the boom 4. Specifically, in a case where the right operation lever 26R is tilted in the longitudinal direction, the operation of the boom 4 is the operation target. The right operation lever 26R uses hydraulic oil discharged from the pilot pump 15 to output, to the secondary side, a pilot pressure according to the operation input in the longitudinal direction.

The two respective inlet ports of the shuttle valve 32BL are connected to the secondary side pilot line of the right operation lever 26R corresponding to an operation of the boom 4 in the raising direction (hereinafter referred to as a "boom raising operation") and the secondary side pilot line of the proportional valve 31BL. The output port of the shuttle valve 32BL is connected to the pilot port at the right side of the control valve 175L and the pilot port at the left side of the control valve 175R.

The two respective inlet ports of the shuttle valve 32BR are connected to the secondary side pilot line of the right operation lever 26R corresponding to an operation of the boom 4 in the lowering direction (hereinafter referred to as a "boom lowering operation") and the secondary side pilot line of the proportional valve 31BR. The output port of the shuttle valve 32BR is connected to the pilot port at the right side of the control valve 175R.

In other words, the right operation lever 26R applies a pilot pressure according to an operation input in the longitudinal direction to the pilot ports of the control valves 175L, 175R through the shuttle valves 32BL, 32BR. Specifically, in a case where the boom raising operation is performed, the right operation lever 26R outputs a pilot pressure according to the operation quantity to one of the inlet ports of the shuttle valve 32BL, and applies the pilot pressure to the pilot port at the right side of the control valve 175L and the pilot port at the left side of the control valve 175R through the shuttle valve 32BL. In a case where the boom lowering operation is performed, the right operation lever 26R outputs a pilot pressure according to the operation quantity to one of the inlet ports of the shuttle valve 32BR, and applies the pilot pressure to the pilot port at the right side of the control valve 175R through the shuttle valve 32BR.

The proportional valve 31BL operates according to a control current received from the controller 30. Specifically, the proportional valve 31BL uses hydraulic oil discharged from the pilot pump 15 to output a pilot pressure, according to a control current received from the controller 30, to the other of the inlet ports of the shuttle valve 32BL. Accordingly, the proportional valve 31BL can adjust the pilot pressures applied to the pilot port at the right side of the control valve 175L and the pilot port at the left side of the control valve 175R through the shuttle valve 32BL.

The proportional valve 31BR operates according to a control current received from the controller 30. Specifically, the proportional valve 31BR uses hydraulic oil discharged from the pilot pump 15 to output a pilot pressure, according to a control current received from the controller 30, to the other of the inlet ports of the shuttle valve 32BR. Accordingly, the proportional valve 31BR can adjust the pilot pressure applied to the pilot port at the right side of the control valve 175R through the shuttle valve 32BR.

Specifically, without relying on the operation state of the right operation lever 26R, the proportional valves 31BL, 31BR can adjust the pilot pressures that are output to the secondary side, so that the control valves 175L, 175R can be stopped at any given valve positions.

The pressure reduction proportional valve 33BL operates according to a control current received from the controller 30. Specifically, in a case where a control current is not received from the controller 30, the pressure reduction proportional valve 33BL outputs, to the secondary side, the pilot pressure corresponding to the boom raising operation of the right operation lever 26R without change. Conversely, in a case where a control current is received from the controller 30, the pressure reduction proportional valve 33BL reduces, to such a degree according to the control current, the pilot pressure in the secondary side pilot line corresponding to the boom raising operation of the right operation lever 26R, and outputs the reduced pilot pressure to one of the inlet ports of the shuttle valve 32BL. Accordingly, even in a case where the boom raising operation is performed with the right operation lever 26R, the pressure reduction proportional valve 33BL can forcibly inhibit or stop, as necessary, the operation of the boom cylinder 7 corresponding to the boom raising operation. Also, even in a case where the boom raising operation is performed with the right operation lever 26R, the pressure reduction proportional valve 33BL can reduce the pilot pressure applied to one of the inlet ports of the shuttle valve 32BL to a pressure less than the pilot pressure applied to the other of the inlet ports of the shuttle valve 32BL from the proportional valve 31BL. Therefore, the controller 30 can control the proportional valve 31BL and the pressure reduction proportional valve 33BL, and reliably apply a desired pilot pressure to the boom raising-side pilot ports of the control valves 175L, 175R.

The pressure reduction proportional valve 33BR operates according to a control current received from the controller 30. Specifically, in a case where a control current is not received from the controller 30, the pressure reduction proportional valve 33BR outputs, to the secondary side, the pilot pressure corresponding to the boom lowering operation of the right operation lever 26R without change. Conversely, in a case where a control current is received from the controller 30, the pressure reduction proportional valve 33BR reduces, to such a degree according to the control current, the pilot pressure in the secondary side pilot line corresponding to the boom lowering operation of the right operation lever 26R, and outputs the reduced pilot pressure to one of the inlet ports of the shuttle valve 32BR. Accordingly, even in a case where the boom lowering operation is performed with the right operation lever 26R, the pressure reduction proportional valve 33BR can forcibly inhibit or stop, as necessary, the operation of the boom cylinder 7 corresponding to the boom lowering operation. Also, even in a case where the boom lowering operation is performed with the right operation lever 26R, the pressure reduction proportional valve 33BR can reduce the pilot pressure applied to one of the inlet ports of the shuttle valve 32BR to a pressure less than the pilot pressure applied to the other of the inlet ports of the shuttle valve 32BR from the proportional valve 31BR. Therefore, the controller 30 can control the proportional valve 31BR and the pressure reduction proportional valve 33BR and can reliably apply a desired pilot pressure to the boom lowering-side pilot ports of the control valves 175L, 175R.

In this manner, the pressure reduction proportional valves 33BL, 33BR can forcibly inhibit or stop the operation of the boom cylinder 7 corresponding to the operation state of the right operation lever 26R in the longitudinal direction. Also, the pressure reduction proportional valves 33BL, 33BR can reduce the pilot pressure applied to one of the inlet ports of the shuttle valves 32BL, 32BR to provide support so that the pilot pressures of the proportional valves 31BL, 31BR are reliably applied to the pilot ports of the control valves 175L, 175R through valves the shuttle 32BL, 32BR, respectively.

Instead of controlling the pressure reduction proportional valve 33BL, the controller 30 may forcibly inhibit or stop the operation of the boom cylinder 7 corresponding to the boom raising operation of the right operation lever 26R by controlling the proportional valve 31BR. For example, in a case where the boom raising operation is performed with the right operation lever 26R, the controller 30 can control the proportional valve 31BR to apply a predetermined pilot pressure to the boom lowering-side pilot ports of the control valves 175L, 175R through the shuttle valve 32BR from the proportional valve 31BR. Accordingly, the pilot pressures are applied to the boom lowering-side pilot ports of the control valves 175L, 175R against the pilot pressure applied to the pilot ports of the boom raising side of the control valves 175L, 175R from the right operation lever 26R through the shuttle valve 32BL. Therefore, the controller 30 can forcibly inhibit or stop the operation of the boom cylinder 7 corresponding to the boom raising operation of the right operation lever 26R by forcibly bringing the control valves 175L, 175R to the neutral position. Likewise, instead of controlling the pressure reduction proportional valve 33BR, the controller 30 may forcibly inhibit or stop the operation of the boom cylinder 7 corresponding to the boom lowering operation of the right operation lever 26R by controlling the proportional valve 31BL.

The operation pressure sensor 29RA detects, as a pressure (an operation pressure), an operator's operation input to the right operation lever 26R in the longitudinal direction, and the controller 30 receives a detection signal corresponding to the detected pressure. Accordingly, the controller 30 can ascertain the operation input to the right operation lever 26R in the longitudinal direction.

Independently from the boom raising operation performed by the operator with the right operation lever 26R, the controller 30 can supply hydraulic oil discharged from the pilot pump 15 to the pilot port at the right side of the control valve 175L and the pilot port at the left side of the control valve 175R through the proportional valve 31BL and the shuttle valve 32BL. Independently from the boom lowering operation performed by the operator with the right operation lever 26R, the controller 30 supplies hydraulic oil discharged from the pilot pump 15 to the pilot port at the right side of the control valve 175R through the proportional valve 31BR and the shuttle valve 32BR. Specifically, the controller 30 can achieve the automatic driving function, the remote operation function, and the like of the shovel 100 by automatically controlling the operation of the raising lowering of the boom 4.

Figure 4C:
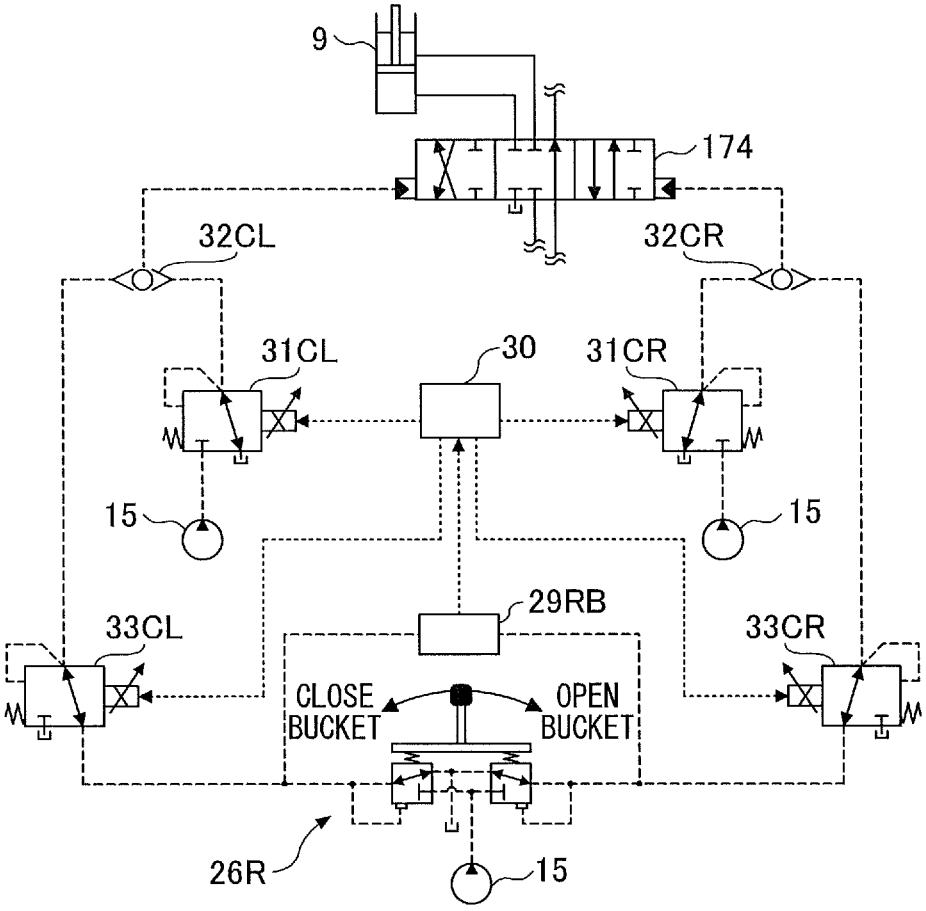
FIG. 4C is a drawing illustrating an example of a portion constituting the operation system for operating a bucket in the hydraulic system of the shovel.

As illustrated in FIG. 4C, the right operation lever 26R is tilted by the operator in the lateral direction to operate the bucket cylinder 9 corresponding to the bucket 6. Specifically, in a case where the right operation lever 26R is tilted in the lateral direction, the operation of the bucket 6 is the operation target. The right operation lever 26R uses hydraulic oil discharged from the pilot pump 15 to output, to the secondary side, a pilot pressure according to the operation input in the lateral direction:

The two respective inlet ports of the shuttle valve 32CL are connected to the secondary side pilot line of the right operation lever 26R corresponding to an operation in a direction to close the bucket 6 (hereinafter referred to as a "bucket closing operation") and the secondary side pilot line of the proportional valve 31CL. The output port of the shuttle valve 32CL is connected to the pilot port at the left side of the control valve 174.

The two respective inlet ports of the shuttle valve 32CR are connected to the secondary side pilot line of the right operation lever 26R corresponding to an operation in a direction to open the bucket 6 (hereinafter referred to as a "bucket opening operation") and the secondary side pilot line of the proportional valve 31CR. The output port of the shuttle valve 32CR is connected to the pilot port at the right side of the control valve 174.

Specifically, the right operation lever 26R applies a pilot pressure according to an operation input in the lateral direction to the pilot port of the control valve 174 through the shuttle valves 32CL, 32CR. Specifically, in a case where the bucket closing operation is performed, the right operation lever 26R outputs a pilot pressure according to the operation quantity to one of the inlet ports of the shuttle valve 32CL, and applies the pilot pressure to the pilot port at the left side of the control valve 174 through the shuttle valve 32CL. In a case where the bucket opening operation is performed, the right operation lever 26R outputs a pilot pressure according to the operation quantity to one of the inlet ports of the shuttle valve 32CR, and applies the pilot pressure to the pilot port at the right side of the control valve 174 through the shuttle valve 32CR.

The proportional valve 31CL operates according to a control current received from the controller 30. Specifically, the proportional valve 31CL uses hydraulic oil discharged from the pilot pump 15 to a pilot pressure according to control a current received from the controller 30 to the other of the pilot ports of the shuttle valve 32CL. Accordingly, the proportional valve 31CL can adjust the pilot pressure applied to the pilot port at the left side of the control valve 174 through the shuttle valve 32CL.

The proportional valve 31CR operates according to a control current received from the controller 30. Specifically, the proportional valve 31CR uses hydraulic oil discharged from the pilot pump 15 to output a pilot pressure according to a control current received from the controller 30 to the other of the pilot ports of the shuttle valve 32CR. Accordingly, the proportional valve 31CR can adjust the pilot pressure applied to the pilot port at the right side of the control valve 174 through the shuttle valve 32CR.

Specifically, independently from the operation state of the right operation lever 26R, the proportional valves 31CL, 31CR can adjust the pilot pressures that are output at the secondary side, so that the control valve 174 can be stopped at any given valve position.

The pressure reduction proportional valve 33CL operates according to a control current received from the controller 30. Specifically, in a case where a control current is not received from the controller 30, the pressure reduction proportional valve 33CL outputs, to the secondary side, the pilot pressure corresponding to the bucket closing operation of the right operation lever 26R without change. Conversely, in a case where a control current is received from the controller 30, the pressure reduction proportional valve 33CL reduces, to such a degree according to the control current, the pilot pressure in the secondary side pilot line corresponding to the bucket closing operation of the right operation lever 26R, and outputs the reduced pilot pressure to one of the inlet ports of the shuttle valve 32CL. Accordingly, even in a case where the bucket closing operation is performed with the right operation lever 26R, the pressure reduction proportional valve 33CL can forcibly inhibit or stop, as necessary, the operation of the bucket cylinder 9 corresponding to the bucket closing operation. Also, even in a case where the bucket closing operation is performed with the right operation lever 26R, the pressure reduction proportional valve 33CL can reduce the pilot pressure applied to one of the inlet ports of the shuttle valve 32CL to a pressure less than the pilot pressure applied to the other of the inlet ports of the shuttle valve 32CL from the proportional valve 31CL. Accordingly, the controller 30 can control the proportional valve 31CL and the pressure reduction proportional valve 33CL, and reliably apply a desired pilot pressure to the bucket closing-side pilot port of the control valve 174.

The pressure reduction proportional valve 33CR operates according to a control current received from the controller 30. Specifically, in a case where a control current is not received from the controller 30, the pressure reduction proportional valve 33CR outputs, to the secondary side, the pilot pressure corresponding to the bucket opening operation of the right operation lever 26R without change. Conversely, in a case where a control current is received from the controller 30, the pressure reduction proportional valve 33CR reduces, to such a degree according to the control current, the pilot pressure in the secondary side pilot line corresponding to the bucket opening operation of the right operation lever 26R, and outputs the reduced pilot pressure to one of the inlet ports of the shuttle valve 32CR. Accordingly, even in a case where the bucket opening operation is performed with the right operation lever 26R, the pressure reduction proportional valve 33CR can forcibly inhibit or stop, as necessary, the operation of the bucket cylinder 9 corresponding to the bucket opening operation. Also, even in a case where the bucket opening operation is performed with the right operation lever 26R, the pressure reduction proportional valve 33CR can reduce the pilot pressure applied to one of the inlet ports of the shuttle valve 32CR to a pressure less than the pilot pressure applied to the other of the inlet ports of the shuttle valve 32CR from the proportional valve 31CR. Accordingly, the controller 30 can control the proportional valve 31CR and the pressure reduction proportional valve 33CR, and can reliably apply a desired pilot pressure to the bucket opening-side pilot port of the control valve 174.

In this manner, the pressure reduction proportional valves 33CL, 33CR can forcibly inhibit or stop the operation of the bucket cylinder 9 corresponding to the operation state of the right operation lever 26R in the lateral direction. The pressure reduction proportional valves 33CL, 33CR can reduce the pilot pressure applied to one of the inlet ports of the shuttle valves 32CL, 32CR to provide support so that the pilot pressures of proportional valves 31CL, 31CR are reliably applied to the pilot port of the control valve 174 through the shuttle valves 32CL, 32CR.

It should be noted that the controller 30 may forcibly inhibit or stop the operation of the bucket cylinder 9 corresponding to the bucket closing operation of the right operation lever 26R by controlling the proportional valve 31CR instead of controlling the pressure reduction proportional valve 33CL. For example, in a case where the bucket closing operation is performed with the right operation lever 26R, the controller 30 may apply a predetermined pilot pressure to the bucket opening-side pilot port of the control valve 174 from the proportional valve 31CR through the shuttle valve 32CR by controlling the proportional valve 31CR. Accordingly, the pilot pressure is applied to the bucket opening-side pilot port of the control valve 174 against the pilot pressure applied to the bucket closing-side pilot port of the control valve 174 from the right operation lever 26R through the shuttle valve 32CL. Therefore, the controller 30 can forcibly inhibit or stop the operation of the bucket cylinder 9 corresponding to the bucket closing operation of the right operation lever 26R by forcibly bringing the control valve 174 to the neutral position. Likewise, the controller 30 may forcibly inhibit or stop the operation of the bucket cylinder 9 corresponding to the bucket opening operation of the right operation lever 26R by controlling the proportional valve 31CL instead of controlling the pressure reduction proportional valve 33CR.

The operation pressure sensor 29RB detects, as a pressure (an operation pressure), an operator's operation input to the right operation lever 26R in the lateral direction, and the controller 30 receives a detection signal corresponding to the detected pressure. Accordingly, the controller 30 can ascertain the operation input to the right operation lever 26R in the lateral direction.

Independently from the bucket closing operation performed by the operator with the right operation lever 26R, the controller 30 can supply hydraulic oil discharged from the pilot pump 15 to the pilot port at the left side of the control valve 174 through the proportional valve 31CL and the shuttle valve 32CL. Independently from the bucket closing operation performed by the operator with the right operation lever 26R, the controller 30 can supply hydraulic oil discharged from the pilot pump 15 to the pilot port at the right side of the control valve 174 through the proportional valve 31CR and the shuttle valve 32CR. Specifically, the controller 30 can achieve the automatic driving function, the remote operation function, and the like of the shovel 100 by automatically controlling the operation of opening and closing of the bucket 6.

Figure 4D:
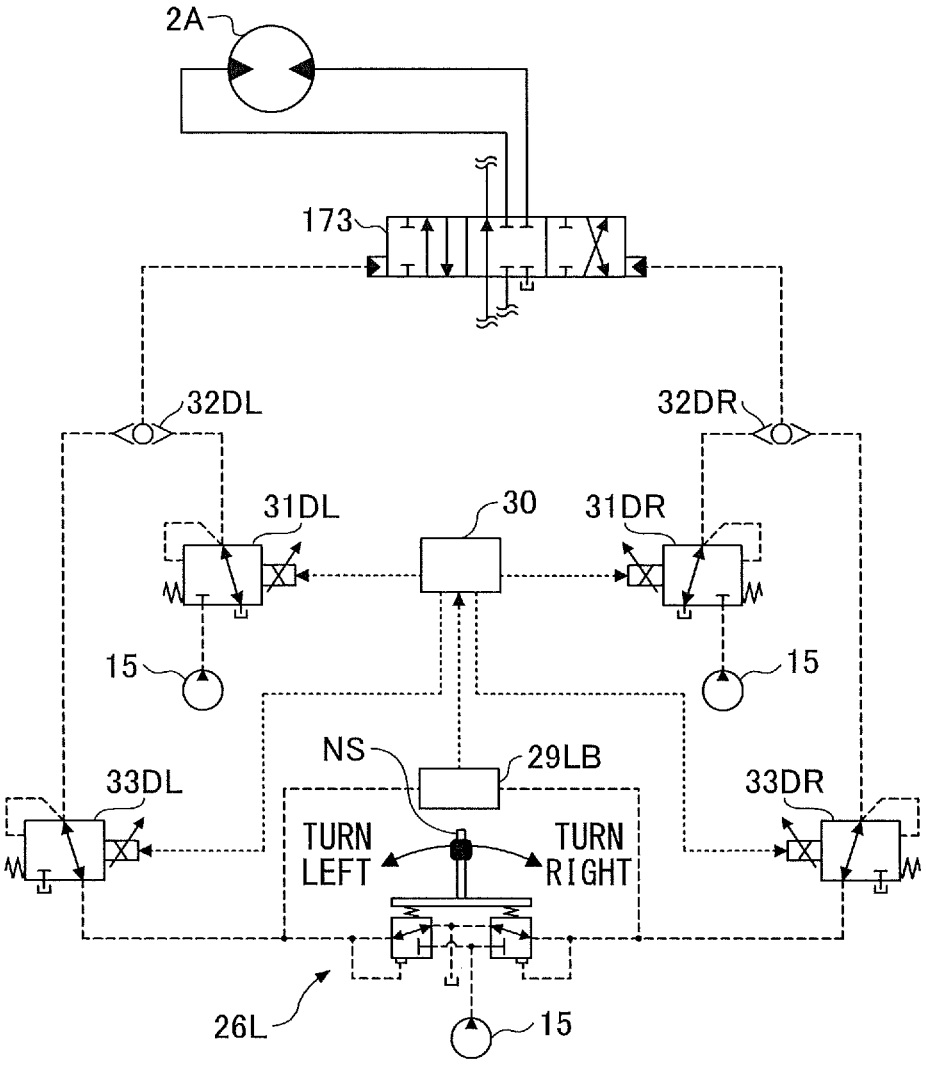
FIG. 4D is a drawing illustrating an example of a portion constituting the operation system for operating an upper turning body in the hydraulic system of the shovel.

For example, as illustrated in FIG. 4D, the left operation lever 26L is tilted by the operator in the lateral direction to operate the turning hydraulic motor 2A corresponding to the upper turning body 3 (the turning mechanism 2). Specifically, in a case where the left operation lever 26L is tilted in the lateral direction, the turning operation of the upper turning body 3 is the operation target. The left operation lever 26L uses hydraulic oil discharged from the pilot pump 15 to output, to the secondary side, a pilot pressure according to the operation input in the lateral direction.

The two respective inlet ports of the shuttle valve 32DL are connected to the secondary side pilot line of the left operation lever 26L corresponding to a turning operation of the upper turning body 3 in the left direction (hereinafter referred to as a "left turning operation") and the secondary side pilot line of the proportional valve 31DL. The output port of the shuttle valve 32DL is connected to the pilot port at the left side of the control valve 173.

The two respective inlet ports of the shuttle valve 32DR are connected to the secondary side pilot line of the left operation lever 26L corresponding to a turning operation of the upper turning body 3 in the right direction (hereinafter referred to as a "right turning operation") and the secondary side pilot line of the proportional valve 31DR. The outlet port of the shuttle valve 32DR is connected to the pilot port at the right side of the control valve 173.

In other words, the left operation lever 26L applies a pilot pressure according to an operation input in the lateral direction to the pilot port of the control valve 173 through the shuttle valves 32DL, 32DR. Specifically, in a case where the left turning operation is performed, the left operation lever 26L outputs a pilot pressure according to the operation quantity to one of the inlet ports of the shuttle valve 32DL, and applies the pilot pressure to the pilot port at the left side of the control valve 173 through the shuttle valve 32DL. In a case where the right turning operation is performed, the left operation lever 26L outputs a pilot pressure according to the operation quantity to one of the inlet ports of the shuttle valve 32DR, and applies the pilot pressure to the pilot port at the right side of the control valve 173 through the shuttle valve 32DR.

The proportional valve 31DL operates according to a control current received from the controller 30. Specifically, the proportional valve 31DL uses hydraulic oil discharged from the pilot pump 15 to output a pilot pressure according to a control current received from the controller 30 to the other of the pilot ports of the shuttle valve 32DL. Accordingly, the proportional valve 31DL can adjust the pilot pressure applied to the pilot port at the left side of the control valve 173 through the shuttle valve 32DL.

The proportional valve 31DR operates according to a control current received from the controller 30. Specifically, the proportional valve 31DR uses hydraulic oil discharged from the pilot pump 15 to output a pilot pressure according to a control current received from the controller 30 to the other of the pilot ports of the shuttle valve 32DR. Therefore, the proportional valve 31DR can adjust the pilot pressure applied to the pilot port at the right side of the control valve 173 through the shuttle valve 32DR.

Specifically, independently from the operation state of the left operation lever 26L, the proportional valves 31DL, 31DR can adjust the pilot pressures that are output at the secondary side, so that the control valve 173 can be stopped at any given valve position.

The pressure reduction proportional valve 33DL operates according to a control current received from the controller 30. Specifically, in a case where a control current is not received from the controller 30, the pressure reduction proportional valve 33DL outputs, to the secondary side, the pilot pressure corresponding to the left turning operation of the left operation lever 26L without change. Conversely, in a case where a control current is received from the controller 30, the pressure reduction proportional valve 33DL reduces, to such a degree according to the control current, the pilot pressure in the secondary side pilot line corresponding to the left turning operation of the left operation lever 26L, and outputs the reduced pilot pressure to one of the inlet ports of the shuttle valve 32DL. Accordingly, even in a case where the left turning operation is performed with the left operation lever 26L, the pressure reduction proportional valve 33DL can forcibly inhibit or stop, as necessary, the operation of the turning hydraulic motor 2A corresponding to the left turning operation. Also, even in a case where the left turning operation is performed with the left operation lever 26L, the pressure reduction proportional valve 33DL can reduce the pilot pressure applied to one of the inlet ports of the shuttle valve 32DL to a pressure less than the pilot pressure applied to the other of the inlet ports of the shuttle valve 32DL from the proportional valve 31DL. Accordingly, the controller 30 can control the proportional valve 31DL and the pressure reduction proportional valve 33DL, and reliably apply a desired pilot pressure to the left turning-side pilot port of the control valve 173.

The pressure reduction proportional valve 33DR operates according to a control current received from the controller 30. Specifically, in a case where a control current is not received from the controller 30, the pressure reduction proportional valve 33DR outputs, to the secondary side, the pilot pressure corresponding to the right turning operation of the left operation lever 26L without change. Conversely, in a case where a control current is received from the controller 30, the pressure reduction proportional valve 33DR reduces, to such a degree according to the control current, the pilot pressure in the secondary side pilot line corresponding to the right turning operation of the left operation lever 26L, and outputs the reduced pilot pressure to one of the inlet ports of the shuttle valve 32DR. Accordingly, even in a case where the right turning operation is performed with the left operation lever 26L, the pressure reduction proportional valve 33DR can forcibly inhibit or stop, as necessary, the operation of the turning hydraulic motor 2A corresponding to the right turning operation. Also, even in a case where the right turning operation is performed with the left operation lever 26L, the pressure reduction proportional valve 33DR can reduce the pilot pressure applied to one of the inlet ports of the shuttle valve 32DR to a pressure less than the pilot pressure applied to the other of the inlet ports of the shuttle valve 32DR from the proportional valve 31DR. Accordingly, the controller 30 can control the proportional valve 31DR and the pressure reduction proportional valve 33DR, and can reliably apply a desired pilot pressure to the right turning-side pilot port of the control valve 173.

In this the manner, pressure reduction proportional valves 33DL, 33DR can forcibly inhibit or stop the operation of the turning hydraulic motor 2A corresponding to the operation state of the left operation lever 26L in the lateral direction. Also, the pressure reduction proportional valves 33DL, 33DR can reduce the pilot pressure applied to one of the inlet ports of the shuttle valves 32DL, 32DR to provide support so that the pilot pressures of the proportional valves 31DL, 31DR are reliably applied to the pilot port of the control valve 173 through the shuttle valves 32DL, 32DR.

Instead of controlling the pressure reduction proportional valve 33DL, the controller 30 may forcibly inhibit or stop the operation of the turning hydraulic motor 2A corresponding to the left turning operation of the left operation lever 26L by controlling the proportional valve 31DR. For example, in a case where the left turning operation is performed with the left operation lever 26L, the controller 30 may apply a predetermined pilot pressure to the right turning-side pilot port through the shuttle valve 32DR control valve 173 from the proportional valve 31DR by controlling the proportional valve 31DR. Accordingly, the pilot pressures are applied to the right turning-side pilot port of the control valve 173 against the pilot pressure applied to the left turning-side pilot port of the control valve 173 through the shuttle valve 32DL from the left operation lever 26L. Therefore, the controller 30 can forcibly inhibit or stop the operation of the turning hydraulic motor 2A corresponding to the left turning operation of the left operation lever 26L by forcibly bringing the control valve 173 to the neutral position. Likewise, instead of controlling the pressure reduction proportional valve 33DR, the controller 30 may forcibly inhibit or stop the operation of the turning hydraulic motor 2A corresponding to the right turning operation of the left operation lever 26L by controlling the proportional valve 31DL.

The operation pressure sensor 29LB detects, as a pressure, an operator's operation input to the left operation lever 26L in the lateral direction, and the controller 30 receives a detection signal corresponding to the detected pressure. Accordingly, the controller 30 can ascertain the operation input to the left operation lever 26L in the lateral direction.

Independently from the left turning operation performed by the operator with the left operation lever 26L, the controller 30 can supply hydraulic oil discharged from the pilot pump 15 to the pilot port at the left side of the control valve 173 through the proportional valve 31DL and the shuttle valve 32DL. Independently from the right turning operation performed by the operator with the left operation lever 26L, the controller 30 can supply hydraulic oil discharged from the pilot pump 15 to the pilot port at the right side of the control valve 173 through the proportional valve 31DR and the shuttle valve 32DR. Specifically, the controller 30 can achieve the automatic driving function, the remote operation function, and the like of the shovel 100 by automatically controlling the turning operation of the upper turning body 3 in the lateral direction.

For the lower traveling body 1, a configuration capable of performing automatic control with the controller 30 may be employed in a manner similar to the boom 4, the arm 5, the bucket 6, and the upper turning body 3. In this case, for example, in the secondary side pilot line between the left traveling lever 26DL and the control valve 171 and the secondary side pilot line between the right traveling lever 26DR and the control valve 172, shuttle valves 32 may be provided, and proportional valves 31 connected to the shuttle valves 32 and capable of being controlled by the controller 30 may be provided. Accordingly, the controller 30 can achieve the automatic driving function, the remote operation function, and the like of the shovel 100 by automatically controlling the traveling operation of the lower traveling body 1 by outputting control currents to the proportional valves 31.

Subsequently, the control system of the shovel 100 according to the present embodiment is explained. The control system of the shovel 100 includes a controller 30, a spatial recognition device 70, an orientation detection device 71, an input device 72, a positioning device 73, a display device D1, a sound output device D2, a boom angle sensor S1, an arm angle sensor S2, a bucket angle sensor S3, a body inclination sensor S4, and a turning state sensor S5.

The controller 30 performs control of the shovel 100 as described above.

For example, the controller 30 drives and controls the engine 11 at a constant rotational speed by setting a target rotation speed on the basis of a task mode and the like, which are set in advance when an operator or the like performs a predetermined operation with the input device 72.

For example, as necessary, the controller 30 outputs a control command to the regulator 13 to change the amount of discharge of the main pump 14.

For example, in a case where the operating apparatus 26 is of an electric type, the controller 30 may achieve operations of the hydraulic actuators according to the operation input of the operating apparatus 26 by controlling the proportional valve 31 as described above.

For example, the controller 30 may achieve the remote operation of the shovel 100 by using the proportional valve 31. Specifically, the controller 30 may output, to the proportional valve 31, a control command corresponding to the content of a remote operation designated by a remote operation signal received from an external device. The proportional valve 31 may use hydraulic oil supplied from the pilot pump 15 to output the pilot pressure corresponding to the control command from the controller 30, and may apply the pilot pressure to the pilot port of the corresponding control valve in the control valve 17. Accordingly, the content of the remote operation is reflected in the operation of the control valve 17, and operations of various kinds of operation elements (driven elements) according to the content of the remote operation are achieved by hydraulic actuators.

Also, for example, the controller 30 performs controls related to a surroundings-monitoring function. The surroundings-monitoring function achieves monitoring an entry of a monitoring-target object into a of predetermined range (hereinafter referred to as a "monitoring range") in the surroundings of the shovel 100 on the basis of information obtained by the spatial recognition device 70. The determination processing for determining the entry of the monitoring-target object into the monitoring range may be performed by the spatial recognition device 70, or may be performed by a unit outside of the spatial recognition device 70 (for example, the controller 30). Examples of monitoring-target objects include a person, a truck, another construction machine, a telephone pole, a suspended load, a pylon, a building, and the like.

Also, for example, the controller 30 performs controls related to an object detection notification function. In a case where the monitoring-target object is determined to be present within the monitoring range by the surroundings-monitoring function, the object detection notification function notifies the presence of the monitoring-target object to the operator in the cab 10 and to people in the surroundings of the shovel 100. For example, the controller 30 may use the display device D1 and the sound output device D2 to implement the object detection notification function.

Also, for example, the controller 30 performs controls related to an operation limiting function. For example, in a case where the monitoring-target object is determined to be present within the monitoring range by the surroundings-monitoring function, the operation limiting function limits the operation of the shovel 100. Hereinafter, a case where the monitoring-target object is a person is mainly explained.

Before the actuators operate, for example, in a case where the monitoring-target object such as a person is determined to be present within a predetermined range (within a monitoring range) from the shovel 100 on the basis of information obtained by the spatial recognition device 70, the controller 30 may disable operations of the actuators or may allow the actuators to operate only in a super slow state even if the operator operates the operating apparatus 26. Specifically, in a case where a person is determined to be present in the monitoring range, the controller 30 causes the gate lock valve to be in the locked state, so that operations of the actuators can be disabled. In a case where the operating apparatus 26 is of an electric type, operations of the actuators can be disabled by invalidating signals from the controller 30 to an operational proportional valve (the proportional valve 31). Even in a case where the operating apparatus 26 is of other types, the above is also applicable so long as the operating apparatus 26 includes an operational proportional valve (the proportional valve 31) outputting a pilot pressure corresponding to a control command from the controller 30 and applying the pilot pressure to the pilot port of the corresponding control valve in the control valve 17. In order to make operations of the actuator in the super slow state, control signals from the controller 30 to the operational proportional valve (the proportional valve 31) are limited to a content corresponding to a relatively small pilot pressure, so that the operations of the actuators can be made into the super slow state. In this manner, when the detected monitoring-target object is determined to be present within the monitoring range, the actuators do not operate or operate at a movement speed smaller than the movement speed corresponding to the operation input into the operating apparatus 26 (i.e., a super slow speed) even when the operating apparatus 26 is operated. Further, even in a case where the monitoring-target object such as a person is determined to be present within the monitoring range while the operator is operating the operating apparatus 26, operations of the actuators can be stopped or decelerated regardless of the operator's operations. Specifically, in a case where a person is determined to be present in the monitoring range, actuators may be stopped by causing the gate lock valve to be in the locked state. In a case where the operating apparatus 26 includes an operational proportional valve (the proportional valve 31) that outputs a pilot pressure corresponding to a control command from the controller 30 and applies the pilot pressure to the pilot port of the corresponding control valve in the control valve 17, operations of the actuators can be disabled or can be limited to only the operations in the super slow state by invalidating signals from the controller 30 to the operational proportional valve (the proportional valve 31) or by inputting a deceleration command to the operational proportional valve (the proportional valve 31). Also, in a case where the detected monitoring-target object is a truck, controls for stopping or deceleration of the actuators may not be performed. For example, the actuators may be controlled to avoid the detected truck. In this manner, the type of the detected object may be recognized, and the actuators may be controlled on the basis of the recognition.

The spatial recognition device 70 is configured to recognize an object that is present in a three-dimensional space of the surroundings of the shovel 100, and measure (calculate) a positional relationship such as a distance to the object recognized by the spatial recognition device 70 or the shovel 100. The spatial recognition device 70 is, for example, an ultrasonic sensor, a millimetre-wave radar, a monocular camera, a stereo camera, a LIDAR (Light Detecting and Ranging) device, a range imaging sensor, an infrared sensor, and the like. In the present embodiment, the spatial recognition device 70 includes a forward recognition sensor 70F attached to the front end of the upper surface of the cab 10, a backward recognition sensor 70B attached to the rear end of the upper surface of the upper turning body 3, a left-side recognition sensor 70L attached to the left end of the upper surface of the upper turning body 3, and a right-side recognition sensor 70R attached to the right end of the upper surface of the upper turning body 3. In addition, an upward recognition sensor may be attached to the shovel 100 to recognize an object that is present in a space immediately above the upper turning body 3.

The orientation detection device 71 detects information about a relative relationship between the orientation of the upper turning body 3 and the orientation of the lower traveling body 1 (for example, the turning angle of the upper turning body 3 with respect to the lower traveling body 1).

For example, the orientation detection device 71 may include a combination of a geomagnetism sensor attached to the lower traveling body 1 and a geomagnetism sensor attached to the upper turning body 3. Also, for example, the orientation detection device 71 may include a combination of a GNSS receiver attached to the lower traveling body 1 and a GNSS receiver attached to the upper turning body 3. Also, for example, the orientation detection device 71 may include a rotary encoder, a rotary position sensor, and the like, i.e., the turning state sensor S5, capable of detecting a relative turning angle of the upper turning body 3 with respect to the lower and for example, the orientation traveling body 1, detection device 71 may be attached to a center joint provided in relation to the turning mechanism 2 that allows the lower traveling body 1 and the upper turning body 3 to rotate relatively with respect to each other. In addition, the orientation detection device 71 may include a camera attached to the upper turning body 3. In this case, the orientation detection device 71 applies known image processing on images (input images) taken by the camera attached to the upper turning body 3 to detect an image of the lower traveling body 1 from among the input images. In addition, by detecting an image of the lower traveling body 1 by using known image recognition techniques, the orientation detection device 71 may identify the longitudinal direction of the lower traveling body 1, and derive an angle formed between the direction of the longitudinal axis of the upper turning body 3 and the longitudinal direction of the lower traveling body 1. In this case, the direction of the longitudinal axis of the upper turning body 3 is derived from the attachment position of the camera. In particular, the crawler 1C is protruding from the upper turning body 3, and therefore, the orientation detection device 71 can detect the longitudinal direction of the lower traveling body 1 by detecting an image of the crawler 1C.

In a case where the upper turning body 3 is configured to be turned by a motor instead of being turned by the turning hydraulic motor 2A, the orientation detection device 71 may be a resolver.

The input device 72 may be provided in an area that can be reached by the operator who sits on the seat in the cab 10, and the input device 72 receives various kinds of operation inputs, and outputs a signal according to an operation input to the controller 30. For example, the input device 72 may include a touch panel implemented on a display of a display device for displaying various kinds of information images. For example, the input device 72 may include button switches, levers, toggle switches, and the like provided around the display device D1. For example, the input device 72 may include knob switches (for example, a switch NS and the like provided on the left operation lever 26L) provided on the operating apparatus 26. Signals corresponding to operation contents to the input device 72 are input to the controller 30.

For example, the switch NS is a push button switch provided at the end of the left operation lever 26L. The operator can operate the left operation lever 26L while pressing the switch NS. The switch NS may be provided on the right operation lever 26R, or may be provided at other positions in the cab 10.

The positioning device 73 measures the position and the orientation of the upper turning body 3. For example, the positioning device 73 is a GNSS (Global Navigation Satellite System) compass that detects the position and the orientation of the upper turning body 3, and the controller 30 receives a detection signal corresponding to the position and the orientation of the upper turning body 3. Of the functions of the positioning device 73, a function for detecting the orientation of the upper turning body 3 may be replaced with an azimuth sensor attached to the upper turning body 3.

The display device D1 is provided at a position that can be easily seen by the operator who sits on the seat in the cab 10, and the display device D1 displays various kinds of information images under the control of the controller 30. The display device D1 may be connected to the controller 30 via an onboard communication network such as CAN (Controller Area Network) and the like, and may be connected to the controller 30 via a private telecommunications circuit for connection between two locations.

For example, the sound output device D2 is provided in the cab 10 and connected to the controller 30. The sound output device D2 outputs sound under the control of the controller 30. For example, the sound output device D2 may be a speaker, a buzzer, and the like. The sound output device D2 outputs various kinds of information in response to a sound output command from the controller 30.

The boom angle sensor S1 is attached to the boom 4 to detect the elevation angle of the boom 4 with respect to the upper turning body 3 (hereinafter referred to as "boom angle"). For example, the boom angle sensor S1 detects the angle formed by a straight line connecting both ends of the boom 4 with respect to the turning plane of the upper turning body 3 in a side view. The boom angle sensor S1 may include, for example, a rotary encoder, an acceleration sensor, a gyroscope sensor (an angular speed sensor), a six-axis sensor, an inertial measurement unit (IMU), and the like. The arm angle sensor S2, the bucket angle sensor S3, and the shovel body inclination sensor S4 are similarly configured as described above. The controller 30 receives detection the signal corresponding to the boom angle detected by the boom angle sensor S1.

The arm angle sensor S2 is attached to the arm 5 to detect a rotation angle of the arm 5 with respect to the boom 4 (hereinafter referred to as an "arm angle"). For example, the arm angle sensor S2 detects an angle formed by a straight line connecting both of the rotational axes points at both ends of the arm 5 with respect to a straight line connecting both of the rotational axes points at both ends of the boom 4 in a side view. The controller 30 receives the detection signal corresponding to the arm angle detected by the arm angle sensor S2.

The bucket angle sensor S3 is attached to the bucket 6 to detect a rotation angle of the bucket 6 with respect to the arm 5 (hereinafter referred to as a "bucket angle"). For example, the bucket angle sensor S3 detects an angle formed by a straight line connecting both of the rotational axes points at both ends of the bucket 6 with respect to a straight line connecting both of the rotational axes points at both ends of the arm 5 in a side view. The controller 30 receives the detection signal corresponding to the bucket angle detected by the bucket angle sensor S3.

The body inclination sensor S4 detects the inclination state of the body (the upper turning body 3 or the lower traveling body 1) with respect to the horizontal plane. For example, the body inclination sensor S4 is attached to the upper turning body 3 to detect inclination angles about two axes, i.e., an inclination angle in the longitudinal direction and an inclination angle in a lateral direction of the shovel 100 (i.e., the upper turning body 3), which are hereinafter referred to as a "longitudinal inclination angle" and a "lateral inclination angle", respectively. The body inclination sensor S4 may include, for example, a rotary encoder, an acceleration sensor, a gyroscope sensor (an angular speed sensor), a six-axis sensor, an IMU, and the like. The controller 30 receives detection signals corresponding to inclination angles (i.e., the longitudinal inclination angle and the lateral inclination angle) detected by the body inclination sensor S4.

The turning state sensor S5 is attached to the upper turning body 3 and is configured to output detection information about the turning state of the upper turning body 3. For example, the turning state sensor S5 detects a turning angular speed and a turning angle of the upper turning body 3. For example, the turning state sensor S5 may include a gyroscope sensor, a resolver, a rotary encoder, and the like.

In a case where the body inclination sensor S4 includes a gyroscope sensor, a six-axis sensor, an IMU, and the like capable of detecting the angular speed around six axes, the turning state (for example, a turning angular speed) of the upper turning body 3 may be detected on the basis of a detection signal of the body inclination sensor S4. In this case, the turning state sensor S5 may be omitted.

[Overview of Machine Guidance Function and Machine Control Function of Shovel]

Subsequently, an overview of the machine guidance function and the machine control function of the shovel is explained with reference to FIG. 5.

Figure 5:
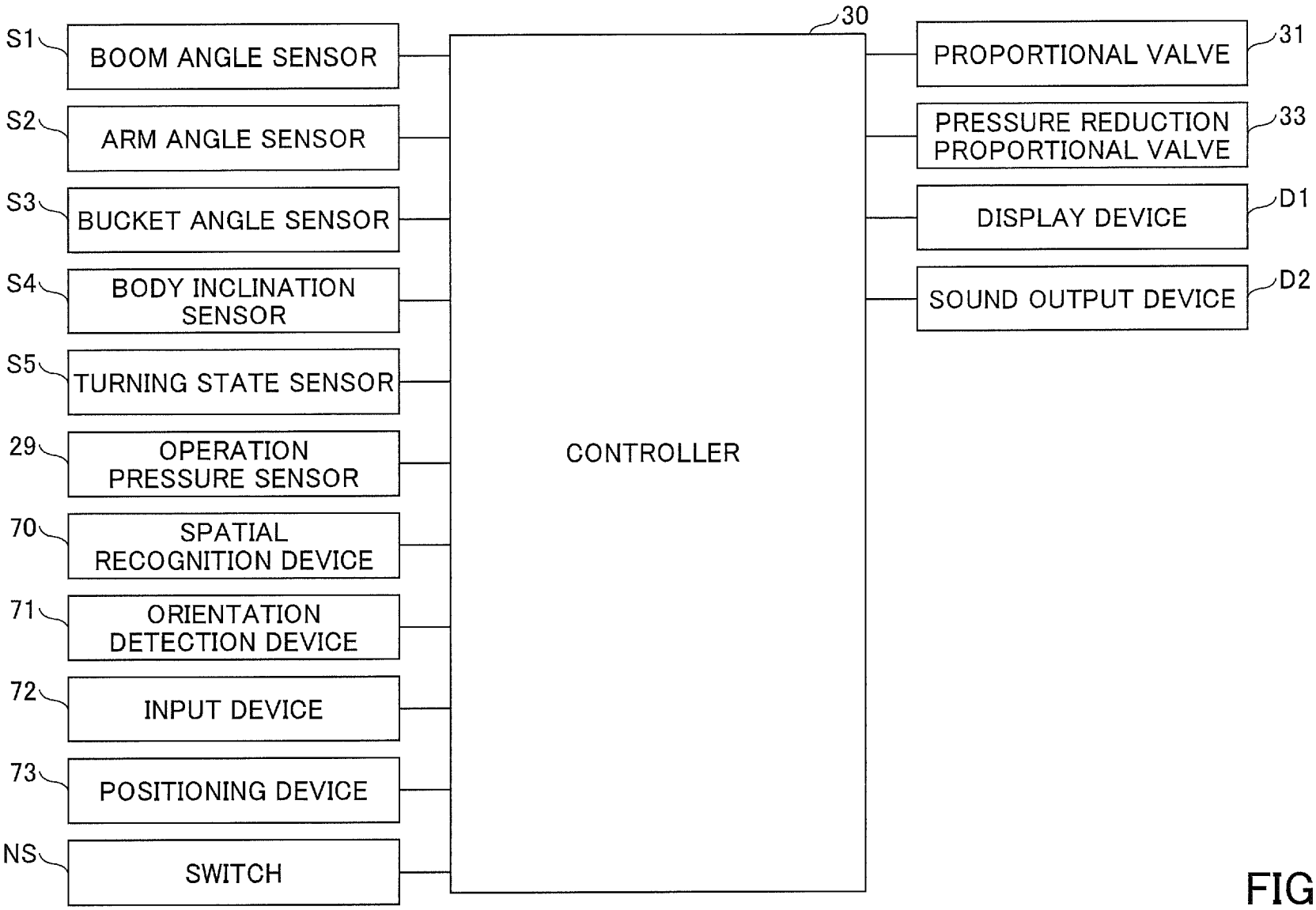
FIG. 5 is a block diagram illustrating an overview of an example of configuration of a machine guidance function and a machine control function of the shovel.

FIG. 5 is a block diagram illustrating an example of configuration of the machine guidance function and the machine control function of the shovel 100.

For example, the controller 30 executes control of the shovel 100 with regard to the machine guidance function for providing guidance on the operator's manual operations of the shovel 100.

For example, by using the display device D1, the sound output device D2, and the like, the controller 30 informs the operator of operation information such as a distance between an excavation target surface (an example of a "planned surface") and a tip portion of the attachment AT, i.e., an operation portion of the end attachment. Specifically, the controller 30 obtains information from a boom angle sensor S1, an arm angle sensor S2, a bucket angle sensor S3, a body inclination sensor S4, a turning state sensor S5, a spatial recognition device 70, a positioning device V1, an input device 72, and the like. Then, for example, the controller 30 may calculate a distance between the bucket 6 and the excavation target surface on the basis of the obtained information, and notify the calculated distance to the operator by causing the display device D1 to display an image or by causing the sound output device D2 to output sound. The data of the excavation target surface may be based on operator's settings and inputs on the input device 72 or downloaded from the outside (for example, from a predetermined management server), and the data may be stored in an internal memory, an external storage device connected to the controller 30, and the like. For example, the data of the excavation target surface is expressed by a reference coordinate system. For example, the reference coordinate system is the World Geodetic System. The World Geodetic System is a three-dimensional orthogonal XYZ coordinate system in which the origin is at the center of gravity of the earth, the X-axis passes through the intersection of the Greenwich meridian and the equator, the Y-axis passes through 90 degrees east longitude, and the Z-axis passes through the north pole. The operator may define any given point on the construction site as a reference point, and may use the input device 72 to set an excavation target surface relative to the reference point. The end portion of the attachment serving as the work part of the bucket includes the teeth end of the bucket 6, the back surface of the bucket 6, and the like. For example, in a case where, instead of the bucket 6, a breaker is employed as the end attachment, the tip portion of the breaker corresponds to the work part. Therefore, the controller 30 can notify task information to the operator with the display device D1, the sound output device D2, and the like, and guide the operator in the operation of the shovel 100 with the operating apparatus 26.

For example, the controller 30 executes control of the shovel 100 with regard to the machine control function for supporting the operator's manual operations of the shovel 100 and automatically or autonomously operating the shovel 100. Specifically, the controller 30 is configured to obtain a target locus, i.e., a locus of a predetermined portion of the attachment (for example, the work part of the end attachment). For example, the controller 30 derives the target locus on the basis of the data of the excavation target surface stored in a non-volatile storage device provided in the controller 30 or a non-volatile storage device that is provided outside of the controller 30 to be able to communicate with the controller 30. The controller 30 may derive the target locus on the basis of information about terrain in the surroundings of the shovel 100 that is recognized by the spatial recognition device 70. The controller 30 may derive information about the past locus of the work part such as the teeth end of the bucket 6 on the basis of past output of an orientation detection device (for example, the boom angle sensor S1, the arm angle sensor S2, the bucket angle sensor S3, and the like) temporarily stored in an internal volatile storage device, and may derive the target locus on the basis of the information. The controller 30 may derive the target locus on the basis of the current position of the predetermined portion of the attachment and the data of the excavation target surface.

For example, in a case where the operator is manually performing an excavation operation, a levelling operation, or the like of the ground, the controller 30 automatically moves at least one of the boom 4, the arm 5, or the bucket 6, so that the position of the end of the bucket 6, i.e., the work part such as the teeth end of the bucket 6, the back surface of the bucket 6, and the like coincides with the excavation target surface. Specifically, when the operator operates the arm 5 with the left operation lever 26L while operating (holding down) the switch NS, the controller 30 automatically operates the boom 4, the arm 5, and the bucket 6, so that the work part of the bucket 6 coincides with the excavation target surface according to the operator's operation for operating the arm 5. Specifically, as described above, the controller 30 automatically moves the boom 4, the arm 5, and the bucket 6 by controlling the proportional valve 31. Accordingly, the operator can cause the shovel 100 to execute an excavation task, a levelling task, and the like according to the excavation target surface by only operating the left operation lever 26L in the longitudinal direction. Hereinafter, the following explanation will be given on the basis of the assumption that the machine control function is enabled in a case where the arm 5 is operated with the left operation lever 26L (i.e., a tilting operation for tilting the left operation lever 26L in the longitudinal direction) while the switch NS is held down.

[Detail of Machine Control Function of Shovel]

Subsequently, the detail of the machine control function is explained with reference to FIG. 6A to FIG. 6C.

Figure 6A:
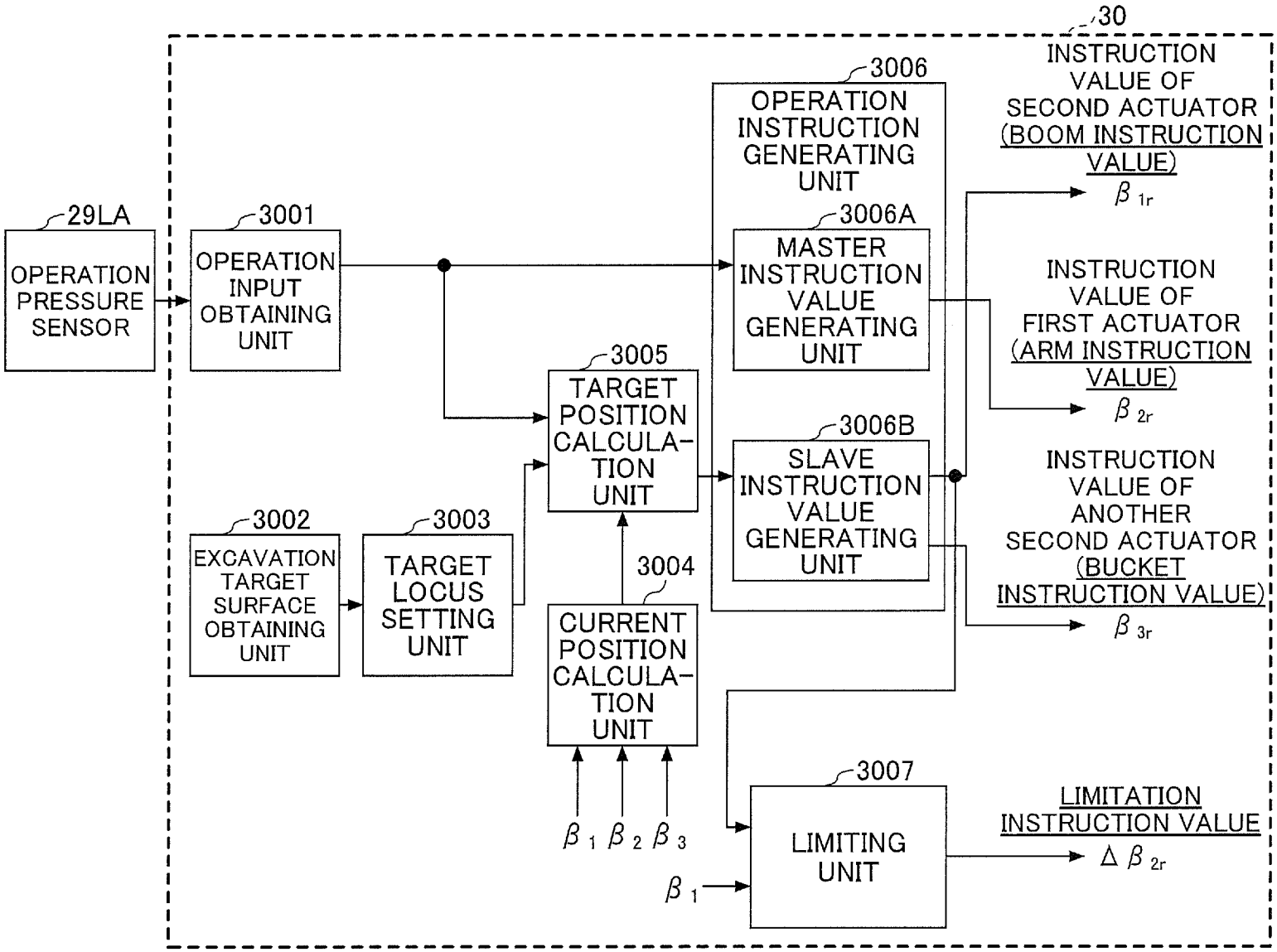
FIG. 6A is a functional block diagram illustrating an example of a detailed configuration of the machine control function of the shovel.
Figure 6B:
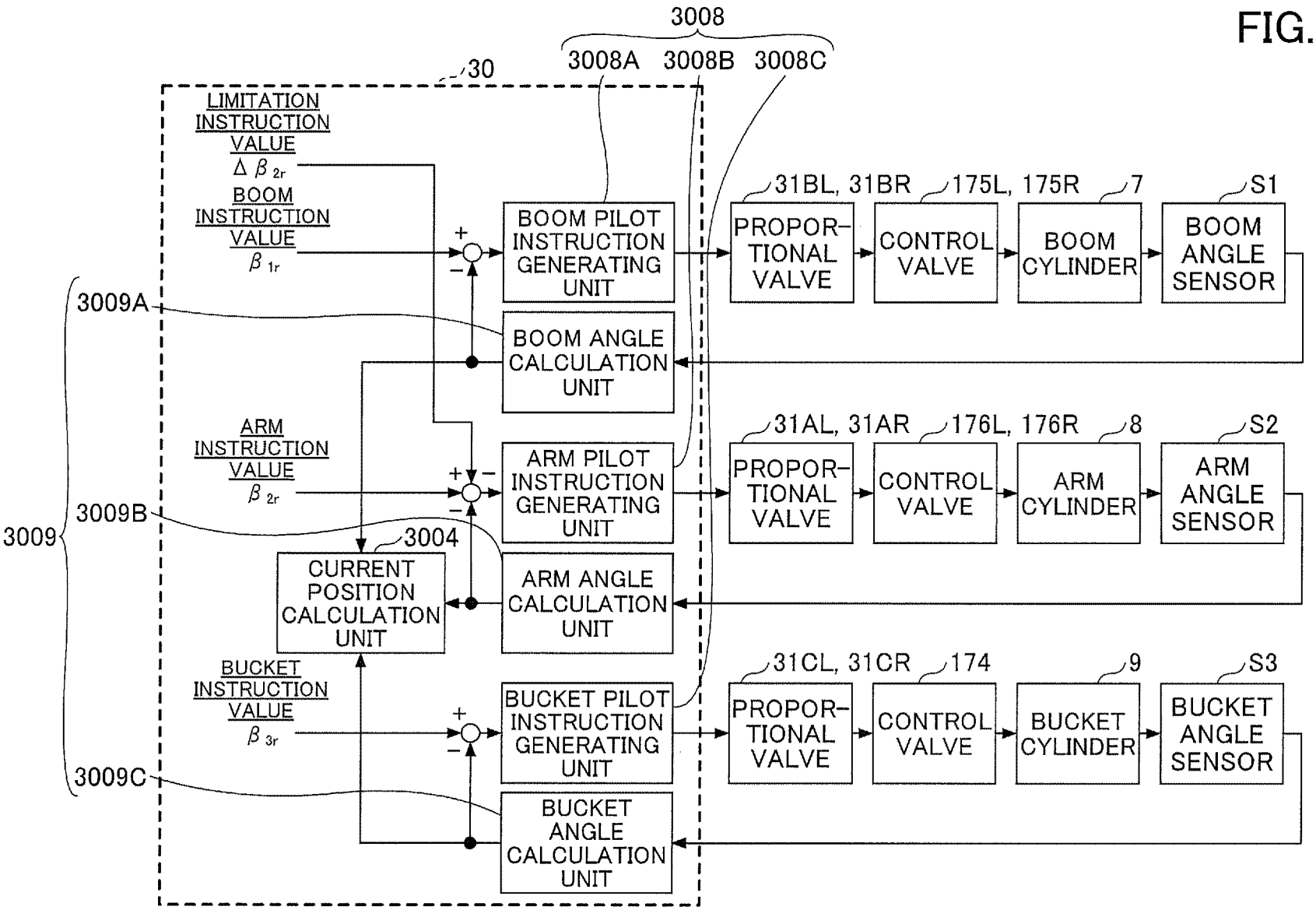
FIG. 6B is a functional block diagram illustrating an example of a detailed configuration of the machine control function of the shovel.

FIG. 6A and FIG. 6B are functional block diagrams illustrating examples of detailed configurations of the machine control function of the shovel 100 according to the present embodiment. Specifically, FIG. 6A and FIG. 6B are functional block diagrams illustrating detailed configuration of a semi-automatic driving function of the shovel 100. FIG. 6C is a functional block diagram illustrating a detailed configuration of the autonomous driving function of the shovel 100. The portion illustrated in FIG. 6B is applicable to both of the semi-automatic driving function and the autonomous driving function. Therefore, the portion corresponding to the autonomous driving function of the shovel 100 is not illustrated, and the autonomous driving function of the shovel 100 is explained by referring to FIG. necessary.

As illustrated in FIG. 6A and FIG. 6B, the controller 30 implementing the semi-automatic driving function of the shovel 100 includes, as functional units for the machine control function, an operation input obtaining unit 3001, an excavation target surface obtaining unit 3002, a target locus setting unit 3003, a current position calculation unit 3004, a target position calculation unit 3005, an operation command generating unit 3006, a limiting unit 3007, a pilot command generating unit 3008, and an attachment angle calculation unit 3009. For example, in a case where the switch NS is held down, the functional units 3001 to 3009 repeatedly execute operations explained later with a predetermined control interval.

Figure 6C:
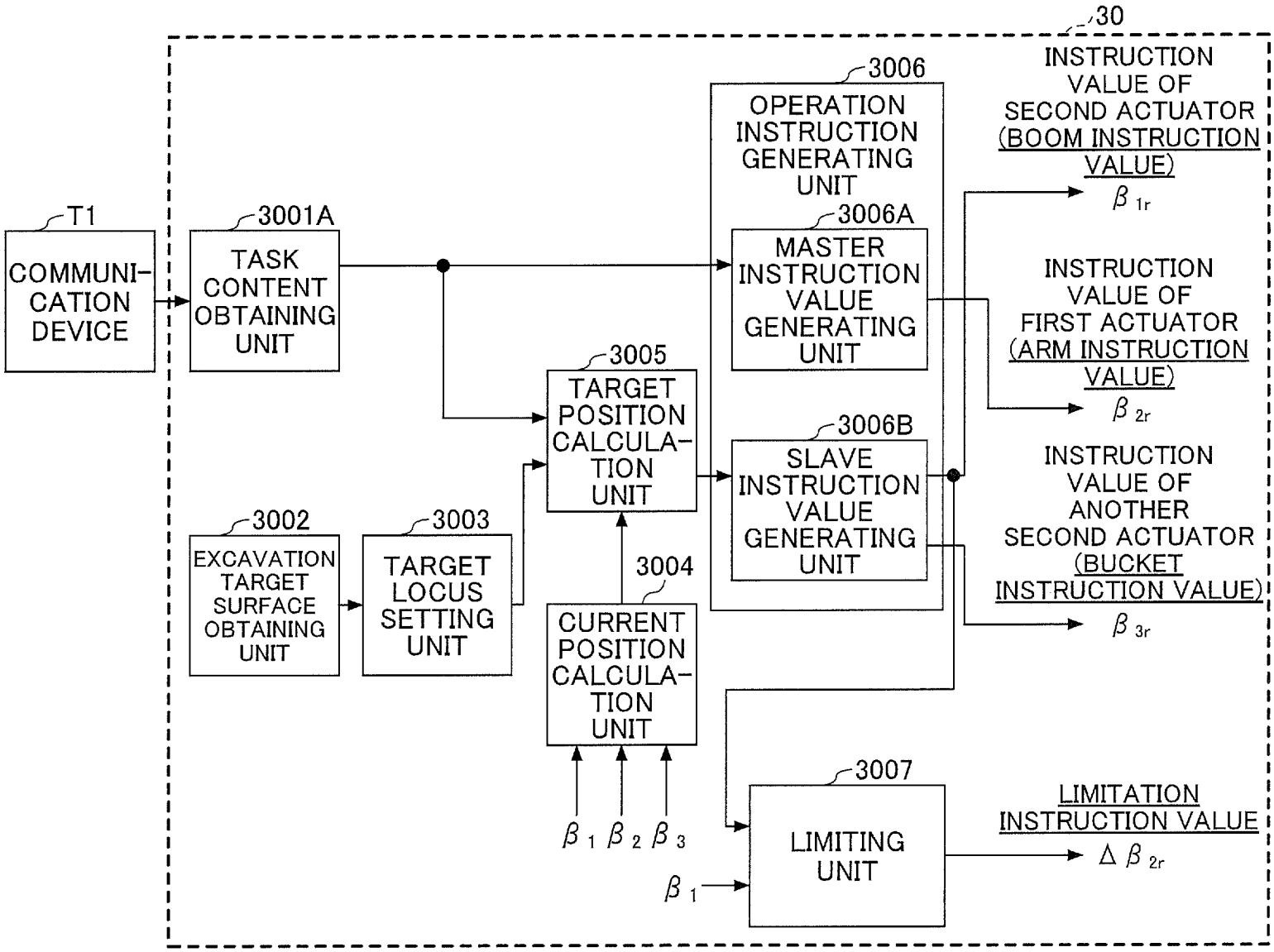
FIG. 6C is a functional block diagram illustrating another example of a detailed configuration of the machine control function of the shovel.

As illustrated in FIG. 6B and FIG. 6C, the controller 30 implementing the autonomous driving function of the shovel 100 includes, as functional units for the machine control function, a task content obtaining unit 3001A, an excavation target surface obtaining unit 3002, a target locus setting unit 3003, a current position calculation unit 3004, a target position calculation unit 3005, an operation command generating unit 3006, a limiting unit 3007, a pilot command generating unit 3008, and an attachment angle calculation unit 3009. For example, in a case where the automatic driving function is enabled, these functional units 3001A and 3002 to 3009 repeatedly execute operations explained later with a predetermined control interval.

Specifically, in a case where the autonomous driving function of the shovel 100 is implemented, the controller 30 is different from the case where the semi-automatic driving function of the shovel 100 is implemented (FIG. 6A) in that the controller 30 includes a task content obtaining unit 3001A instead of the operation input obtaining unit 3001.

The operation input obtaining unit 3001 obtains an operation input to the left operation lever 26L for an operation for operating the arm 5 (i.e., a tilting operation for tilting the left operation lever 26L in the longitudinal direction) on the basis of a detection signal received from the operation pressure sensor 29LA. For example, the operation input obtaining unit 3001 obtains (calculates), as the operation input, an operation direction (i.e., as to which of an arm opening operation or an arm closing operation is performed) and an operation quantity. In a case where the shovel 100 is remotely operated, the semi-automatic driving function of the shovel 100 may be implemented on the basis of a content of a remote operation signal received from an external device. In this case, the operation input obtaining unit 3001 obtains an operation input of a remote operation on the basis of the remote operation signal received from the external device.

Conversely, the task content obtaining unit 3001A obtains, through the communication device T1 provided in the shovel 100, information about the content of a task that is to be executed by the shovel 100 (hereinafter referred to as "task content information") from a predetermined external device (for example, the support device 200 and the management device 300 explained later). For example, the task content information includes the content of the predetermined task performed by the 100, the content of the operations constituting the predetermined task, operation conditions of the predetermined task, a trigger condition for starting the task, and the like. For example, the predetermined task may include an excavation task, a loading task, a levelling task, and the like. For example, in a case where the predetermined task is an excavation task, the operations constituting the predetermined task include an excavation operation, a boom raising and turning operation, an earth unloading operation, a boom lowering turning operation, and the like. For example, in a case where the predetermined task is an excavation task, the operation conditions include conditions of an excavation depth, an excavation length, and the like. The task content obtaining unit 3001A outputs operation commands for the operation elements (the actuators) of the shovel 100 on the basis of the obtained task content information.

For example, the excavation target surface obtaining unit 3002 obtains the data of the excavation target surface from the internal memory, the predetermined external storage device, and the like.

The target locus setting unit 3003 sets, on the basis of the data of the excavation target surface, information about the target locus of the tip portion of the attachment AT, i.e., the work part of the end attachment (for example, the teeth end, the back surface, and the like of the bucket 6) to cause the tip portion of the attachment AT (for example, the teeth end of the bucket 6) to move along the excavation target surface. For example, the target locus setting unit 3003 may set, as the information about the target locus, the inclination angle of the excavation target surface in the longitudinal direction relative to the body (the upper turning body 3) of the shovel 100. With the target locus, a range of permissible error (hereinafter referred to as a "permissible error range") may be set. In this case, the information about the target locus may include information about the permissible error range.

The current position calculation unit 3004 calculates the position (the current position) of the tip portion of the attachment AT (the teeth end of the bucket 6). Specifically, the position of the tip portion of the attachment AT may be calculated on the basis of a boom angle $\beta_1$, an arm angle $\gamma_2$, and a bucket angle $\beta_3$ calculated by the attachment angle calculation unit 3009 explained later.

The target position calculation unit 3005 calculates the target position of the tip portion of the attachment AT on the basis of, in the semi-automatic driving function of the shovel 100, the operation input (the operation direction and the operation quantity) in operator's operation or remote operation for operating the arm 5, the information about the target locus that has been set, and the current position of the tip portion of the attachment AT. The target position is a position on the excavation target surface (i.e., the target locus) that the tip portion of the attachment AT is to reach during the current control period, when it is assumed that the arm 5 moves in accordance with the operation direction and the operation quantity in the operator's operation or the remote operation. For example, the target position calculation unit 3005 may calculate the target position of the tip portion of the attachment AT by using maps, operational expressions, and the like stored in advance in a non-volatile internal memory and the like.

Also, the target position calculation unit 3005 calculates the target position of the tip portion of the attachment AT (the control reference) on the basis of, in the autonomous driving function of the shovel 100, operation commands received from the task content obtaining unit 3001A, the information about the target locus that has been set, and the current position of the control reference (the work part) of the attachment AT. Accordingly, the controller 30 can autonomously control the shovel 100 without relying on operator's operations.

The operation command generating unit 3006 generates a command value (hereinafter referred to as a "boom command value") $\beta_{1r}$ of the operation of the boom 4, a command value (hereinafter referred to as an "arm command value") $\beta_{2r}$ for an operation of the arm 5, and a command value (hereinafter referred to as a "bucket command value") $\beta_{3r}$ for an operation of the bucket 6, on the basis of the target position of the tip portion of the attachment AT. For example, a boom command value $\beta_{1r}$, an arm command value Bar, and a bucket command value $\beta_{3r}$ are a boom angle, an arm angle, and a bucket angle when the tip portion of the attachment AT has reached the target position. The operation command generating unit 3006 includes a master command value generating unit 3006A and a slave command value generating unit 3006B.

The boom command value, the arm command value, and the bucket command value may be the angular speed or the angular acceleration of the boom 4, the arm 5, and the bucket 6, respectively, required for the tip portion of the attachment AT to reach the target position.

The master command value generating unit 3006A generates a command value (hereinafter referred to as a "master command value") of an operation of an operation element (an actuator) operating in response to an operator's operation input or an operation command of the autonomous driving function (hereinafter referred to as a "master element") from among the operation elements constituting the attachment AT (the actuators for driving these operation elements). Hereinafter, the operation element (the actuator) operating in response to an operator's operation input or an operation command of the autonomous driving function and actuators for driving such an operation element may be collectively referred to as a "master element", or each of them may be individually referred to as a "master element". The above is also applicable to a term "slave element" explained below. In the present embodiment, the master element is the arm 5 (the arm cylinder 8), and the master command value generating unit 3006A generates the arm command value $\beta_{2r}$ (a command value of a first actuator), and outputs the arm command value $\beta_{2r}$ to the arm pilot command generating unit 3008B explained later. Specifically, the master command value generating unit 3006A generates the arm command value Bar corresponding to the operator's operation input or the operation command (the operation direction and the operation quantity). For example, the master command value generating unit 3006A may generate and output the arm command value Bar on the basis of a predetermined map, a conversion expression, and the like for defining the relationship between the operator's operation input or the operation command and the arm command value $\beta_{2r}$.

The slave command value generating unit 3006B generates a command value (hereinafter referred to as a "slave command value") of an operation of a slave element operating according to (in synchronization with) the operation of the master element (the arm 5) from among the operation elements constituting the attachment AT (the actuators for driving these operation elements). Specifically, the slave element operates in such a manner that the tip portion (the work part) of the attachment AT, e.g., the teeth end of the bucket 6, moves along the excavation target surface according to (in synchronization with) the operation of the master element (the arm 5 and the arm cylinder 8). In the present embodiment, the slave elements are the boom 4 (the boom cylinder 7) and the bucket 6 (the bucket cylinder 9), and the slave command value generating unit 3006B generates the boom command value $\beta_{1r}$ (a command value of a second actuator) and the bucket command value $\beta_{3r}$ (a command value of another second actuator), and outputs the generated boom command value $\beta_{1r}$ and the generated bucket command value $\beta_{1r}$ to the boom pilot command generating unit 3008A and the bucket pilot unit command generating 3008C explained later. Specifically, the slave command value generating unit 3006B generates the boom command value $\beta_{1r}$ and the bucket command value for so as to cause the boom 4 and the bucket 6 to operate according to (in synchronization with) the operation of the arm 5 corresponding to the arm command value $\beta_{2r}$ so that the tip portion (the work part) of the attachment AT reaches the target position (i.e., moves along the excavation target surface). Accordingly, the controller 30 can cause the tip portion (the work part) of the attachment AT to move along the excavation target surface by causing the boom 4 and the bucket 6 of the attachment AT operate to according to (i.e., in synchronization with) the operation of the arm 5 corresponding to the operator's operation input for the arm 5 or according to the operation command. Specifically, the arm 5 (the arm cylinder 8) operates according to the operator's operation input or the operation command, and the operations of the boom 4 (the boom cylinder 7) and the bucket 6 (the bucket cylinder 9) are controlled according to the operation of the arm 5 (the arm cylinder 8) so that the tip portion (the work part) of the attachment AT, e.g., the teeth end of the bucket 6, moves along the excavation target surface.

In a case where the boom 4 has failed to synchronize with or is likely fail to synchronize with the operation of the arm 5 corresponding to the operator's operation input or the operation command, the limiting unit 3007 limits (slows down) the operation of the arm 5 that is output according to the operator's operation input or the operation command. Specifically, the limiting unit 3007 makes a determination as to whether a predetermined condition (hereinafter referred to as "synchronization inability condition") is satisfied. The synchronization inability condition is a condition in which it can be determined that the operation of the boom 4 has failed to synchronize with or is likely fail to synchronize with the operation of the arm 5. The synchronization inability condition is, for example, conditions in steps S104, S110 of FIG. 7 explained later. Then, in a case where the synchronization inability condition is satisfied, the limiting unit 3007 outputs a control command to the pressure reduction proportional valves 33AL, 33AR or the switch valves to cause the pilot line to be in the non-communication state, generates the limitation command value $\Delta\beta_{2r}$ for limiting the operation of the arm 5, and outputs the generated limitation command value $\Delta\beta_{2r}$ to the arm pilot command generating unit 3008B explained later. The operation of the arm 5 is determined by the operator's operation input and the operation command for the autonomous driving function. Therefore, as described above, in a case where the boom command value $\beta_{1r}$ is generated according to the operation of the arm 5, the boom command value $\beta_{1r}$ that is beyond the limitation of the operation of the boom 4 (for example, the limitation of the speed or the acceleration related to the operation) may be generated. In such a case, the controller 30 limits (slows down) the operation of the arm 5 to such a degree that the operation of the boom 4 can synchronize with the operation of the arm 5, so that circumstances where the operation of the boom 4 have failed to synchronize with the operation of the arm 5 can be avoided. The operation of the limiting unit 3007, specifically, control processing for limiting the speed and the like of the operation of the arm 5 (hereinafter referred to as "arm speed limiting processing") is explained later in detail (see FIG. 7).

Without relying on whether the operation of the boom 4 can synchronize with the operation of the arm 5, the limiting unit 3007 may generate the limitation command value $\Delta\beta_{2r}$ and output the generated limitation command value $\Delta\beta_{2r}$ to the arm pilot command generating unit 3008B. Specifically, the limiting unit 3007 may output, to the arm pilot command generating unit 3008B, the limitation command value $\Delta\beta_{2r}$ (=0) that is set to zero, in a case where the operation of the boom 4 is successfully synchronizing with the operation of the arm 5 corresponding to the operator's operation input or the operation command.

The pilot command generating unit 3008 generates a command value of a pilot pressure (hereinafter referred to as a "pilot pressure command value") that is applied to the control valves 174 to 176 for attaining the boom angle, the arm angle, and the bucket angle corresponding to the boom command value $\beta_{1r}$, the arm command value $\beta_{2r}$, and the bucket command value $\beta_{3r}$. The pilot command generating unit 3008 includes a boom pilot command generating unit 3008A, an arm pilot command generating unit 3008B, and a bucket pilot command generating unit 3008C.

The boom pilot command generating unit 3008A generates pilot pressure command values applied to the control valves 175L, 175R corresponding to the boom cylinder 7 for driving the boom 4, on the basis of a difference between the boom command value $\beta_{1r}$ and the calculated value (the measured value) of the current boom angle calculated by a boom angle calculation unit 3009A explained later. Then, the boom pilot command generating unit 3008A outputs control currents corresponding to the generated pilot pressure command values to the proportional valves 31BL, 31BR. Accordingly, in a manner as described above, the pilot pressures corresponding to the pilot pressure command values that are output from the proportional valves 31BL, 31BR are applied to the corresponding pilot ports of the control valves 175L, 175R through the shuttle valves 32BL, 32BR. Accordingly, due to the actions of the control valves 175L, 175R, the boom cylinder 7 operates to cause the boom 4 to move so as to attain the boom angle corresponding to the boom command value $\beta_{1r}$.

In a case where the operation of the boom 4 is successfully synchronizing with the operation of the arm 5 (for example, in a case where the limitation command value $\Delta\beta_{2r}$ is not output from the limiting unit 3007), the arm pilot command generating unit 3008B generates pilot pressure command values applied to the control valves 176L, 176R corresponding to the arm cylinder 8 for driving the arm 5, on the basis of a difference between the arm command value $\beta_{2r}$ and the calculated value (the measured value) of the current arm angle calculated by the arm angle calculation unit 3009B explained later. Then, the arm pilot command generating unit 3008B outputs control currents corresponding to the generated pilot pressure command values to the proportional valves 31AL, 31AR. Accordingly, in a manner as described above, command values that are output from the proportional valves 31AL, 31AR are applied to the corresponding pilot ports of the control valves 176L, 176R through the shuttle valves 32AL, 32AR. Accordingly, due to the actions of the control valves 176L, 176R, the arm cylinder 8 operates to cause the arm 5 to move so as to attain the arm angle corresponding to the arm command value $\beta_{2r}$.

In a case where the operation of the boom 4 has failed to synchronize with or is likely fail to synchronize with the operation of the arm 5 (for example, in a case where the limitation command value $\Delta\beta_{2r}$ is output from the limiting unit 3007), the arm pilot command generating unit 3008B generates pilot pressure command values applied to the control valves 176L, 176R on the basis of a difference between a command value obtained by subtracting the limitation command value $\Delta\beta_{2r}$ from the arm command value Bar (hereinafter referred to as a "corrected arm command value") and the calculated value (the measured value) of current arm angle. Then, the arm pilot command generating unit 3008B outputs control current corresponding to the generated pilot pressure command values to the proportional valves 31AL, 31AR. Accordingly, in a manner as described above, the pilot pressures corresponding to the pilot pressure command value that are output from the proportional valves 31AL, 31AR are applied to the corresponding pilot ports of the control valves 176L, 176R through the shuttle valves 32AL, 32AR. Accordingly, due to the actions of the control valves 176L, 176R, the arm cylinder 8 operates to cause the arm 5 to move so as to attain the arm angle corresponding to the corrected arm command value.

In the semi-automatic driving function of the shovel 100 (FIG. 6A), in a case where the operator of the cab 10 operates the left operation lever 26L, the arm pilot command generating unit 3008B may omit the generation of the pilot pressure command value and the output of control currents corresponding to the pilot pressure command values to the proportional valves 31AL, 31AR, when the synchronization inability condition is not satisfied. This is because, in normal circumstances, the pressure reduction proportional valves 33AL, 33AR or the switch valves can output, to the secondary side, the pilot pressures corresponding to the operation input to the left operation lever 26L without change, and apply the pilot pressures to the control valves 176L, 176R through the shuttle valves 32AL, 32AR. In the semi-automatic driving function of the shovel 100 (FIG. 6A), in a case where the operator of the cab 10 operates the left operation lever 26L, the operation command generating unit 3006 may omit the generation of the arm command value $\beta_{2r}$, when the synchronization inability condition is not satisfied, due to similar reasons. In the semi-automatic driving function of the shovel 100 (FIG. 6A), in a case where the operator of the cab 10 operates the left operation lever 26L, the function for generating the arm command value $\beta_{2r}$ may be omitted in the operation command generating unit 3006. In this case, when the synchronization inability condition is satisfied, for example, the limiting unit 3007 may calculate a command value corresponding to an operation input to the left operation lever 26L for operating the arm 5 (i.e., a command value corresponding to the arm command value Bar) on the basis of the detection signal from the operation pressure sensor 29AL, generate a limitation command value corresponding to a value obtained by subtracting the limitation command value $\Delta\beta_{2r}$ explained above from the calculated command value, and output the generated limitation command value to the arm pilot command generating unit 3008B. Specifically, in a case where the synchronization inability condition is satisfied, the limiting unit 3007 may generate a limitation command value that is less than the command value corresponding to the operation input to the left operation lever 26L for operating the arm 5, and output the limitation command value to the arm pilot command generating unit 3008B.

The bucket pilot command generating unit 3008C generates the pilot pressure command value applied to the control valve 174 corresponding to the bucket cylinder 9 for driving the bucket 6, on the basis of a difference between the bucket command value $\beta_{3r}$ and the calculated value (the measured value) of the current bucket angle calculated by the bucket angle calculation unit 3009C explained later. Then, the bucket pilot command generating unit 3008C outputs control currents corresponding to the generated pilot pressure command values to the proportional valves 31CL, 31CR. Accordingly, as described above, the pilot pressures corresponding to the pilot pressure command values that are output from the proportional valves 31CL, 31CR are applied to the corresponding pilot ports of the control valves 174 through the shuttle valves 32CL, 32CR. Accordingly, due to the actions of the control valve 174, the bucket cylinder 9 operates to cause the bucket 6 to move so as to attain the bucket angle corresponding to the bucket command value $\beta_{3r}$.

The attachment angle calculation unit 3009 calculates the (current) boom angle, the (current) arm angle, and the (current) bucket angle on the basis of detection signals of the boom angle sensor S1, the arm angle sensor S2, and the bucket angle sensor S3. The attachment angle calculation unit 3009 includes the boom angle calculation unit 3009A, an arm angle calculation unit 3009B, and a bucket angle calculation unit 3009C.

The boom angle calculation unit 3009A calculates (measures) the boom angle on the basis of the detection signal received from the boom angle sensor S1. Accordingly, the boom pilot command generating unit 3008A can perform feedback control of the operation of the boom cylinder 7 on the basis of the measurement result of the boom angle calculation unit 3009A.

The arm angle calculation unit 3009B calculates (measures) the arm angle on the basis of the detection signal received from the arm angle sensor S2. Accordingly, the arm pilot command generating unit 3008B can perform feedback control of the operation of the operation of the arm cylinder 8 on the basis of the measurement result of the arm angle calculation unit 3009B.

The bucket angle calculation unit 3009C calculates (measures) the bucket angle on the basis of the detection signal received from the bucket angle sensor S3. Accordingly, the bucket pilot command generating unit 3008C can perform feedback control of the operation of the bucket cylinder 9 on the basis of the measurement result of the bucket angle calculation unit 3009C.

[Detail of Arm Speed Limiting Processing]

Subsequently, a processing flow of arm speed limiting processing performed by the controller 30 is explained with reference to FIG. 7.

Figure 7:
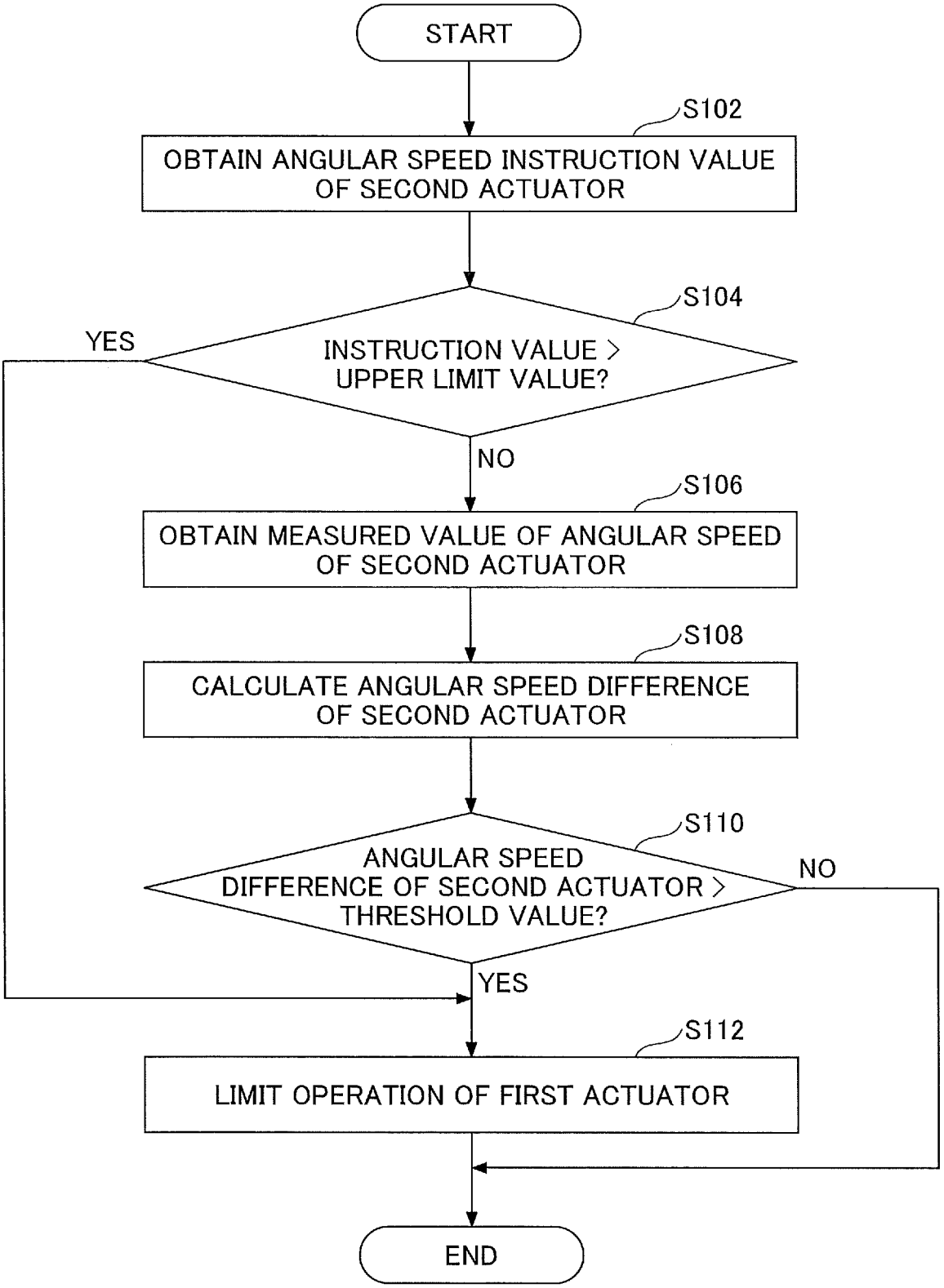
FIG. 7 is a flowchart schematically illustrating an example of arm speed limiting processing performed by a controller for the shovel.

FIG. 7 is a flowchart schematically illustrating an example of arm speed limiting processing performed by the controller 30 (i.e., the limiting unit 3007) of the shovel 100 according to the present embodiment.

In step S102, the limiting unit 3007 obtains a command value (hereinafter referred to as a "boom angular speed command value") corresponding to the angular speed of the boom 4 (driven by the boom cylinder 7 serving as a second actuator). For example, the limiting unit 3007 may calculate the boom angular speed command value on the basis of a difference between the boom command value $\beta_{1r}$ generated in the current control period and the current boom angle $\beta_1$ calculated by the boom angle calculation unit 3009A. Also, as described above, in a case where the operation command generating unit 3006 generates the boom command value, the arm command value, and the bucket command value corresponding to the angular speeds of the boom 4, the arm 5, and the bucket 6, respectively, required to cause the tip portion of the attachment AT to reach the target position, the limiting unit 3007 may obtain, as the boom angular speed command value, the boom command value generated by the operation command generating unit 3006 without change.

In step S104, the limiting unit 3007 determines whether any given synchronization inability condition is the satisfied. Specifically, limiting unit 3007 determines whether the obtained boom angular speed command value is more than the upper limit value of the angular speed of the boom 4 (hereinafter referred to as a "boom angular speed upper limit value").

The boom angular speed upper limit value is defined in advance as a limit value of the angular speed that can be output by the boom 4 in terms of mechanism of the attachment (or a value with a certain amount of margin from the limit value), and may be different according to various parameters such as the orientation of the boom 4, i.e., the boom angle and the operation direction of the boom 4 (i.e., whether the operation direction is a raising direction or a lowering direction), the output of the engine 11 (the configured rotation speed of the engine 11), and the like. Therefore, the limiting unit 3007 may calculate the boom angular speed upper limit value by using a dynamic model and the like of the attachment of the shovel 100 defined in advance on the basis of the current values of the variable parameters explained above. Also, the limiting unit 3007 may calculate the boom angular speed upper limit value by using a map and the like, defined in advance, indicating a relationship between the boom angular speed upper limit value and the various parameters of the variable parameters explained above, on the basis of the current values explained above.

In a case where the boom angular speed command value is not more than the boom angular speed upper limit value, the limiting 3007 determines that the operation of the boom 4 is in a state capable of synchronizing with operation of the arm 5, and proceeds to step S106. Conversely, in a case where the boom angular speed command value is more than the boom angular speed upper limit value, the limiting unit 3007 determines that the operation of the boom 4 cannot synchronize with the operation of the arm 5, and proceeds to step S112.

In step S102, the limiting unit 3007 may obtain the measured value of the angular speed of the boom 4 (hereinafter referred to as a "boom angular speed measured value"), and in step S104, the limiting unit 3007 may determine whether the boom angular speed measured value is more than the boom angular speed upper limit value explained above. In this case, for example, the limiting unit 3007 may obtain (calculate) the boom angular speed measured value on the basis of a difference between a boom angle $\beta_1$ calculated in the current control period by the boom angle calculation unit 3009A and a boom angle $\beta_1$ calculated in the previous control period by the boom angle calculation unit 3009A. In a case where the detection signal of the boom angle sensor S1 includes a detection signal corresponding to the angular speed of the boom 4, the limiting unit 3007 may calculate the boom angular speed measured value on the basis of the detection signal. In step S102, the limiting unit 3007 obtains a command value corresponding to the angular acceleration of the boom 4 (hereinafter referred to as a "boom angular acceleration command value"), and in step S104, the limiting unit 3007 may determine whether the boom angular acceleration command value is more than a predetermined upper limit value (hereinafter referred to as a "boom angular acceleration upper limit value"). In this case, for example, the limiting unit 3007 may calculate the boom angular acceleration command value on the basis of the boom command value $\beta_{1r}$ generated in the current control period and a history of the boom angle $\beta_1$ for the current period and several periods in the past including the previous period, each boom angle 31 in the history of the boom angle $\beta_1$ being calculated in the corresponding control period by the boom angle calculation unit 3009A. Similarly to the case of the boom angular speed upper limit value, the boom angular acceleration upper limit value may be defined in advance as a limit value of the angular acceleration that can be output by the boom 4 (or a value with a certain amount of margin from the limit value being changeable according to value), the limit various parameters such as the boom angle and the operation direction of the boom 4, the output of the engine 11, and the like. In step S102, the limiting unit 3007 may obtain a measured value corresponding to the angular acceleration of the boom 4 (hereinafter referred to as a "boom angular acceleration measured value"), and in step S104, the limiting unit 3007 may determine whether the boom angular acceleration measured value is more than the boom angular acceleration upper limit value.

In step S106, the limiting unit 3007 obtains the boom angular speed measured value (corresponding to the operation of the boom cylinder 7 serving as the second actuator).

In step S108, the limiting unit 3007 calculates a difference (hereinafter referred to as a "boom angular speed difference") between a boom angular speed command value (corresponding to a difference between the command value and the measured value of the boom cylinder 7 serving as the second actuator) and the boom angular speed measured value.

In step S110, the limiting unit 3007 determines whether the boom angular speed difference (corresponding to a difference between the command value and the measured value of the boom cylinder r 7 serving as the second actuator) is more than a predetermined threshold value.

For example, the threshold value may be defined in advance as a limit value of variation width in which the angular speed of the boom 4 can vary within the control period under the constraints imposed by the mechanism and the like of the attachment (or a value with a certain amount of margin from the limit value). Similarly with the case of the boom angular speed upper limit value, the threshold value can change according to the orientation of the boom 4, i.e., the boom angle and the operation direction of the boom 4 (i.e., whether the operation direction is a raising direction or a lowering direction) and the like. Therefore, the limiting unit 3007 may calculate the threshold value by using a dynamic model and the like of the attachment of the shovel 100 defined in advance on the basis of the current boom angle, the operation direction of the boom 4, and the like. Also, the limiting unit 3007 may calculate the threshold value by using a map and the like, defined in advance, indicating a relationship between the threshold value and parameters such as the boom angle and the operation direction of the boom 4, on the basis of the current boom angle, the operation direction of the boom 4, and the like.

In a case where the boom angular speed difference is not more than the threshold value, the limiting unit 3007 determines that the operation of the boom 4 (the boom cylinder 7) can synchronize with the operation of the arm 5 (the arm cylinder 8), and terminates the current processing. Conversely, in a case where the boom angular speed difference is more than the threshold value, the limiting unit 3007 determines that the operation of the boom 4 (the boom cylinder 7) is likely to fail to synchronize with the operation of the arm 5 (the arm cylinder 8), and proceeds to step S112.

In step S108, the limiting unit 3007 calculates a difference between the angular acceleration command value of the boom 4 and the measured value of the angular acceleration of the boom 4 (hereinafter referred to as a "boom angular acceleration measured value"), and in step S110, the limiting unit 3007 may determine whether a difference between the angular acceleration command value of the boom 4 and the boom angular acceleration measured value is more than a predetermined threshold value. Similarly to the case of the threshold value corresponding to the boom angular speed difference, the threshold value may be defined in advance as a limit value of variation width in which the angular acceleration of the boom 4 can vary (or a value with a certain amount of margin from the limit value), the limit value being changeable according to the boom angle, the operation direction of the boom 4, and the like.

In step S112, the limiting unit 3007 limits and slows down the operation of the arm 5 (an arm cylinder first actuator). Specifically, as described above, the limiting unit 3007 outputs control commands of the pressure reduction proportional valves 33AL, 33AR or the switch valves, outputs the limitation command value $\beta\beta_{2r}$ to arm the pilot command generating unit 3008B, and terminates the processing in the current control period. Accordingly, as described above, the controller 30 can slow down the actual operation of the arm 5 relative to the operation of the arm 5 corresponding to the operator's operation input and the operation command.

The series of processing in steps S102, S104 and the series of processing in steps S106 to S110 explained above may be processed in parallel.

[Effects]

Subsequently, the effects of the shovel 100 according to the present embodiment are explained with reference to FIG. 8A, FIG. 8B, and FIG. 9.

Figure 8A:
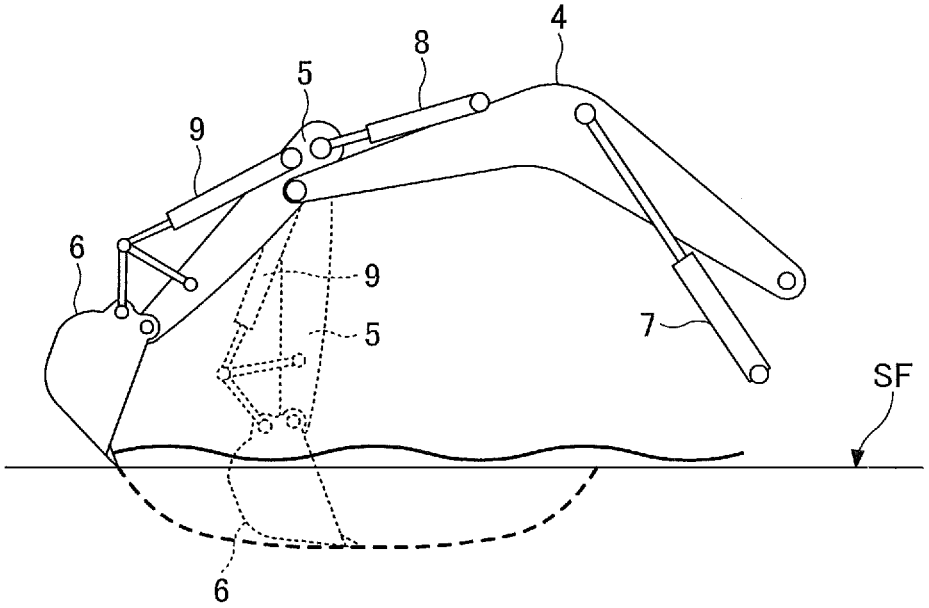
FIG. 8A is a drawing illustrating an operation of an attachment performed by a machine control function of a shovel according to a comparative example.
Figure 8B:
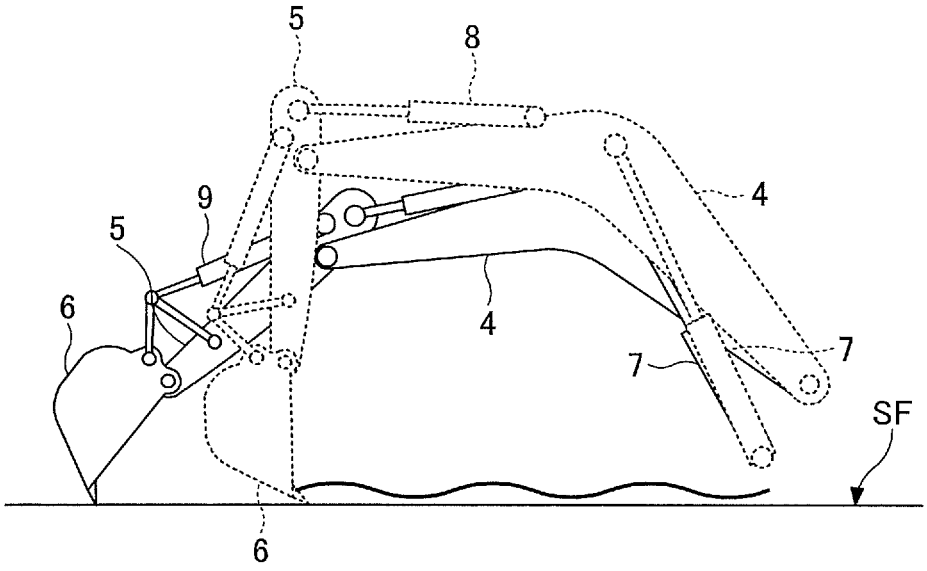
FIG. 8B is a drawing illustrating an example of an operation of the attachment performed by the machine control function of the shovel according to the embodiment.
Figure 9:
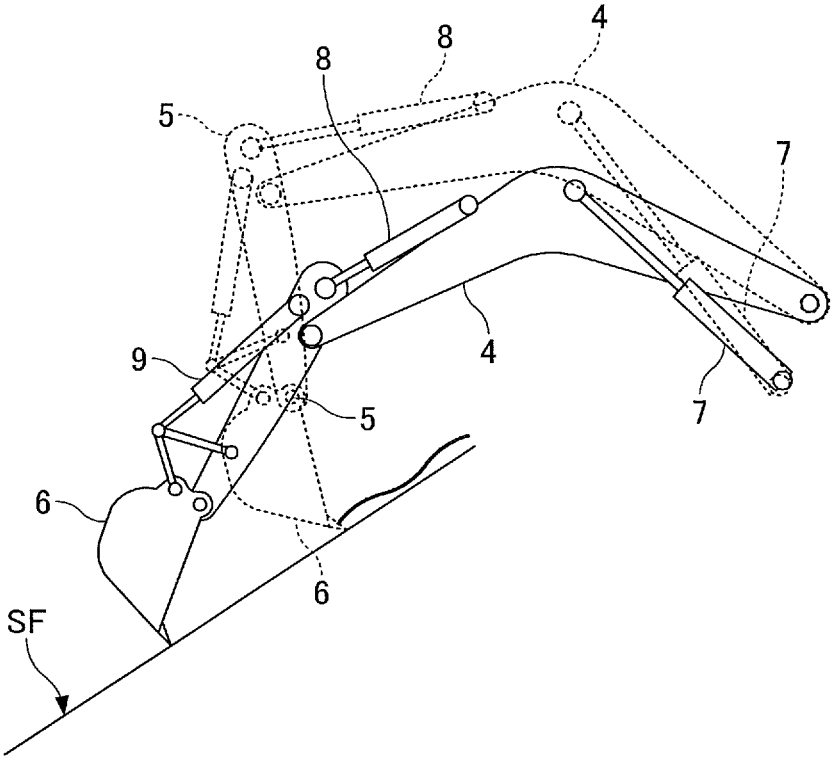
FIG. 9 is a drawing illustrating another example of an operation of the attachment performed by the machine control function of the shovel.

FIG. 8A, FIG. 8B, and FIG. 9 are drawings for explaining the effects of the shovel 100 according to the present embodiment. Specifically, FIG. 8A is a drawing illustrating an example of operation of an attachment AT of a machine control function of a shovel according to a comparative example. FIG. 8B is a drawing illustrating an example of operation of the attachment AT achieved by the machine control function of the shovel 100 according to the present embodiment. FIG. 9 is a drawing illustrating another example of operation of the attachment AT achieved by the machine control function of the shovel 100 according to the present embodiment.

In FIG. 8A, FIG. 8B, and FIG. 9, for the sake of convenience, only the attachment AT of the shovel 100 is illustrated, and the attachment AT of the shovel 100 is operating from the state of the solid line to the state of the broken line. In the shovel according to the comparative example, at least the limiting unit 3007 is omitted from the configuration of the shovel 100 according to the present embodiment.

For example, depending on how operators operate the arm 5 (for example, a movement speed and the like) or depending on the operation command, the operation of the boom 4 required to cause the teeth end and the like of the bucket 6 to move along the excavation target surface according to the operation of the arm 5 may be beyond the limitation of the operation of the boom 4 (for example, the upper limit values of the angular speed and the angular acceleration).

In such circumstances, in the case of the comparative example, as illustrated in FIG. 8A, the boom 4 cannot perform operation to catch up with (i.e., cannot synchronize its operation with) the operation of the arm 5, and as a result, the locus of the teeth end and the like of the bucket 6 moves beyond an excavation target surface SF (the locus indicated by a broken line in FIG. 8A). This is because the boom 4, i.e., the slave element, has a relatively larger mass (inertia) and accordingly operates more slowly than the arm 5 and the like, i.e., the master element, and therefore, it is desired to adjust the boom 4, i.e., the slave element, to the operation of the arm 5, i.e., the master element.

For the above issue, the present embodiment is configured such that, in a case where the operation of the boom 4 has failed to synchronize with or is likely fail to synchronize with the operation of the arm 5 operating in accordance with the operator's operation input or the operation command for the autonomous driving function, the controller 30 controls (slows down) the operation of the arm 5 such that the operation of the arm 5 corresponds to the operation of the boom 4. In other words, in a case where the operation of the boom cylinder 7 (an example of a second actuator) has failed to synchronize with or is likely fail to synchronize with the operation of the arm cylinder 8 (an example of a first actuator), the controller 30 performs control so as to slow down the actual operation of the arm cylinder 8 relative to the operation expected from the operator's operation and the operation command (the operation quantity). Specifically, in a case where a condition for determining that the operation of the boom cylinder 7 has failed to synchronize with or is likely fail to synchronize with the operation of the arm cylinder 8, i.e., the synchronization inability condition, is satisfied, the controller 30 more greatly slows down the operation of the arm cylinder 8 corresponding to the operator's operation and the operation command for operating the arm 5, than in the case where the synchronization inability condition is not satisfied. Accordingly, the speed (the angular speed) and the acceleration (the angular acceleration) of the operation of the arm 5 are reduced to a speed or an acceleration less than the speed (the angular speed) or the acceleration (the angular acceleration) corresponding to the operator's operation and the operation command (the operation quantity) for operating the arm 5. Therefore, as illustrated in FIG. 8B, the boom 4 can operate so that the teeth end of the bucket 6 moves along the excavation target surface in accordance with the operation of the arm 5 corrected to slow down relative to the operation corresponding to the operator's operation and the operation command (the operation quantity) for operating the arm 5. Therefore, the shovel 100 according to the present embodiment can more appropriately cause the tip portion of the attachment AT (for example, the work part such as the teeth end of the bucket 6) to move along the excavation target surface in accordance with the operator's operation and the operation command for the autonomous driving function.

Also, for example, as illustrated in FIG. 9, when the inclination of the excavation target surface SF relatively increases, the amount of movement of the bucket 6 in the vertical direction is desired to be increased in order to cause the teeth end and the like of the bucket 6 to move along the excavation target surface SF. In other words, the operation of the boom 4 for moving the bucket 6 in the vertical direction is desired to have a higher responsiveness than the operation of the arm 5 for moving the bucket 6 in the horizontal direction. For this reason, when the inclination of the excavation target surface SF is relatively large, the operation of the boom 4 required to cause the teeth end and the like of the bucket 6 to move along the excavation target surface in accordance with the operation of the arm 5 corresponding to the operator's operation for operating the arm 5 and the operation command (the operation quantity) for operating the arm 5 in the autonomous driving function is likely to move beyond the limitation of the operation of the boom 4. As a result, the operation of the attachment becomes jerky, and it is possible that the shovel 100 (the controller 30) fails to move the bucket 6 smoothly along the excavation target surface SF.

For the above issue, in the present embodiment, in a manner as described above, in a case where the operation of the boom 4 has failed to synchronize with or is likely fail to synchronize with the operation of the arm 5 operating according to the operator's operation and the operation command for operating the arm 5 in the autonomous driving function, the controller 30 slows down the operation of the arm 5. Therefore, the boom 4 (the boom cylinder 7) can operate so that the teeth end of the bucket 6 moves along the excavation target surface SF in accordance with the operation of the arm 5 (the arm cylinder 8) corrected to slow down relative to the operation of the arm 5 (the arm cylinder 8) and the operation corresponding to the operation command (the operation quantity). Therefore, even in a case where the inclination of the excavation target surface SF is relatively large, the shovel 100 according to the present embodiment can more appropriately cause the tip portion of the attachment AT (for example, the work part such as the teeth end of the bucket 6) to move along the excavation target surface in accordance with the operator's operation and the operation command for the autonomous driving function.

Similarly with the case of the operation of the boom 4 (the boom cylinder 7), the controller 30 may determine whether the synchronization inability condition of the operation of the bucket 6 (the bucket cylinder 9) with respect to the operation of the arm 5 corresponding to the operator's operation and the operation command for the arm 5 in the autonomous driving function is satisfied. In addition, in a case where the controller 30 determines that the synchronization inability condition is satisfied, i.e., determines that the operation of the bucket 6 has failed to synchronize with or is likely fail to synchronize with e operation of the arm 5, the controller 30 may slow down the operation of the arm 5. In other words, in a case where the operation of the bucket cylinder 9 (an example of a second actuator) has failed to synchronize with or is likely fail to synchronize with the operation of the arm cylinder 8 (an example of a first actuator), the controller 30 may slow down the operation of the arm cylinder 8 corresponding to the operation of the arm 5 or the operation command for the autonomous driving function.

[Shovel Management System]

Subsequently, a shovel management system SYS is explained with reference to FIG. 10.

Figure 10:
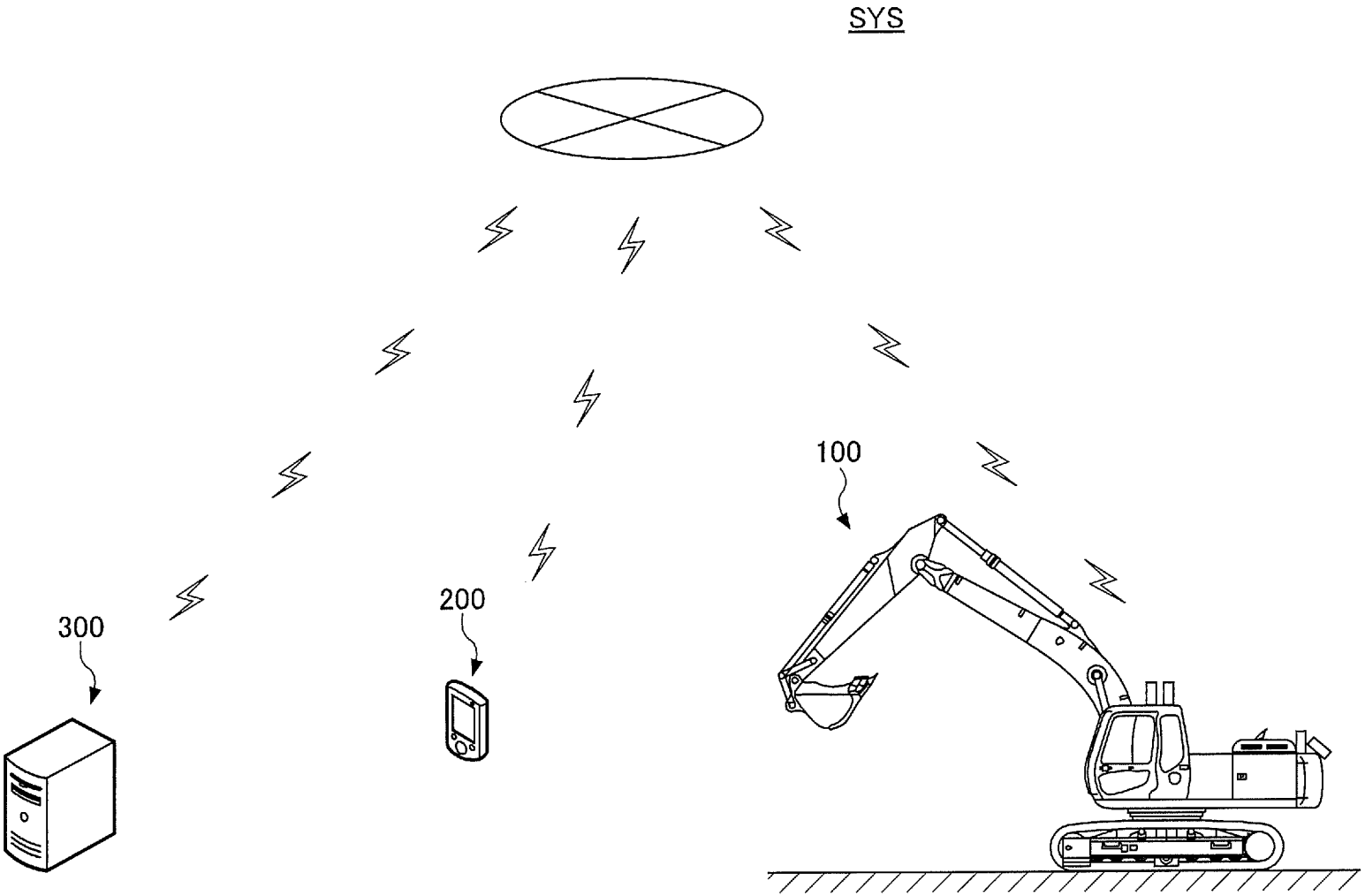
FIG. 10 is a schematic diagram illustrating an example of a shovel management system.

FIG. 10 is a schematic diagram illustrating an example of the shovel management system SYS.

As illustrated in FIG. 10, the shovel management system SYS includes a shovel 100, a support device 200, and a management device 300. The shovel management system SYS is a system for managing one or more shovels 100.

Information obtained by the shovel 100 may be shared with an administrator, operators of other shovels, and the like through the shovel management system SYS. The shovel management system SYS may include one or more shovels 100, one or more support devices 200, and one or more management devices 300. In this example, the shovel management system SYS includes a single shovel 100, a single support device 200, and a single management device 300.

Typically, the support device 200 is a portable terminal device, and is, for example, a laptop type computer terminal, a tablet terminal, a smartphone, or the like carried by a worker and the like who are at the construction site. The support device 200 may be a portable terminal carried by the operator of the shovel 100. The support device 200 may be a fixed terminal device.

Typically, the management device 300 is a fixed terminal device, and is, for example, a server computer provided in an administration center and the like outside of the construction site (what is termed as a cloud server). For example, the management device 300 may be, for example, an edge server that is configured in the construction site. Also, the management device 300 may be a portable terminal device (for example, a portable terminal such as a laptop type computer terminal, a tablet terminal, a smartphone, or the like).

The support device 200 or the management device 300 or both of the support device 200 or the management device 300 may be provided with a display device and an operating apparatus for remote operation. In this case, an operator who uses the support device 200 and the management device 300 may operate the shovel 100 while using the operating apparatus for remote operation. For example, the operating apparatus for remote operation is connected communicably with the controller 30 provided on the shovel 100 through a radio communication network such as a near-field radio communication network, a portable telephone communication network, a satellite communication network, or the like.

Also, various kinds of information images displayed on the display device D1 provided in the cab 10 (for example, image information showing the situation of the surroundings of the shovel 100, various kinds of setting screens, and the like) may be displayed on the display device connected to the support device 200 or the management device 300 or connected to both. The image information showing the situation of the surroundings of the shovel 100 may be generated based on images captured by the spatial recognition device 70. Accordingly, the worker who uses the support device 200, the administrator who uses the management device 300, or the like can remotely operate the shovel 100 and configure various settings of the shovel 100, while ascertaining the situations of the surroundings of the shovel 100.

For example, in the shovel management system SYS, the controller 30 of the shovel 100 may transmit information about the machine control function being executed to the support device 200 or the management device 300 or to both. In this case, the controller 30 may transmit the output of the spatial recognition device 70 or an image taken by a monocular camera or may transmit both of them to the support device 200 or the management device 300 or to both. The image may include multiple images taken while the machine control function is being executed. Further, the controller 30 may transmit information about data of operation inputs of the shovel 100 during execution of the machine control function, data of orientation of the shovel 100, data of the orientation of the excavation attachment, or the like, to the support device 200 or the management device 300 or to both. This is to allow the worker who uses the support device 200 or the administrator who uses the management device 300 to obtain information about the shovel 100 during execution of the machine control function.

In this manner, the shovel management system SYS can share information about the shovel 100 obtained during execution of the machine control function, with an administrator, operators of other shovels, and the like.

[Modification and Changes]

Although the embodiment has been described in detail above, the present disclosure is not limited to the above embodiment, and various modifications and changes can be made without departing from the scope of the claimed subject matter.

For example, in the embodiment explained above, the master element is the arm 5, and the slave elements are the boom 4 and the bucket 6. Alternatively, the master element may be the boom 4, and the slave elements may be the arm 5 and the bucket 6. In this case, similarly with the case where the master element is the arm 5, in a case where the synchronization inability condition is satisfied, i.e., the operation of the arm 5 or the bucket 6 or both of the arm 5 and the bucket 6 has failed to synchronize with or is likely fail to synchronize with the operation of the boom 4, the controller 30 may slow down the operation of the boom 4. In other words, in a case where the operation of the arm cylinder 8 or the bucket cylinder 9 or both of the arm cylinder 8 and the bucket cylinder 9 (each of which is an example of a second actuator) has failed to synchronize with or is likely fail to synchronize with the operation of the boom cylinder 7 (an example of a first actuator), the controller 30 may slow down the operation of the boom cylinder 7 corresponding to the operator's operation for operating the boom 4.

In the above embodiment and the modifications, the machine control function of the operation of the attachment has been explained in detail. However, the machine control function may be applied to the operation of the shovel 100 including not only the attachment but also the upper turning body 3 and the lower traveling body 1. For example, the master control function may be applied to a complex operation for operating the upper turning body 3 (the turning hydraulic motor) and the attachment during the boom raising and turning operation of the shovel 100. In this case, the controller 30 may control the operation of the upper turning body 3 (the turning hydraulic motor 2A) serving as the master element by controlling the proportional valves 31DL, 31DR and the pressure reduction proportional valves 33DL, 33DR in accordance with the operator's operation input or the operation command for the autonomous driving function. Also, the controller 30 may control the operation of the boom 4 (the boom cylinder 7) serving as the slave element in accordance with the operation of the upper turning body 3 (the turning hydraulic motor 2A) by controlling the proportional valves 31BL, 31BR and the pressure reduction proportional valves 33BL, 33BR. In a case where the synchronization inability condition is satisfied, the controller 30 may limit the operation of the upper turning body 3 (the turning hydraulic motor 2A), and may control the operation of the upper turning body 3 (the turning hydraulic motor 2A) such that the operation of the upper turning body 3 (the turning motor 2A corresponds to the operation of the boom 4 (the boom cylinder 7). For example, the synchronization inability condition may be that "the height of the bucket 6 from the ground is less than a predetermined reference", and the predetermined reference may be varied in such a manner that the predetermined reference increases according to an increase of the turning angle of the upper turning body 3 from the start of turning. Accordingly, in a case where the speed of the boom raising operation is relatively smaller than the turning operation of the upper turning body 3, the controller 30 can inhibit or prevent the bucket 6 from coming into contact with the bed of a dump truck when the bucket 6 has not yet been raised to a sufficiently high position from the ground.

In the above embodiment and the modifications, the conditions of the angular speeds of the boom 4, the arm 5, the bucket 6, and the like are defined as the synchronization inability condition, but the embodiment is not limited thereto. For example, instead of or in addition to the conditions of the angular speeds of the boom 4, the arm 5, the bucket 6, and the like explained above, a condition of the state of the work part of the end attachment (for example, the teeth end, the back surface, and the like of the bucket 6) may be defined as the synchronization inability condition. Specifically, in the synchronization inability condition, the speed of the work part of the end attachment in the vertical direction with respect to the excavation target surface may be defined.

In the above embodiment and the modifications, the shovel 100 is configured to hydraulically drive all of the various kinds of operation elements such as the lower traveling body 1, the upper turning body 3, the boom 4, the arm 5, the bucket 6, and the like. Alternatively, some of them may be configured to be electrically driven. For example, instead of being hydraulically driven by the turning hydraulic motor 2A, the upper turning body 3 may be electrically driven by a turning electric motor (an example of a turning actuator). In other words, the configuration and the like disclosed in the above embodiment may be applied to hybrid shovels, electric shovels, and the like.

According to the above embodiment and the modifications, the technique capable of more appropriately moving the tip portion of the attachment of the shovel along the planned surface can be provided.

What is claimed is:

1. A shovel comprising:

a lower traveling body;

an upper turning body turnably mounted on the lower traveling body;

an attachment attached to the upper turning body;

a plurality of actuators including a first actuator and a second actuator and configured to drive the attachment and the upper turning body, the first actuator being configured to operate in response to an operator's operation input or an operation command of an autonomous driving function, the second actuator being configured to operate independent of the operator's operation input or the operation command; and a processor configured to control an operation of the second actuator in accordance with an operation of the first actuator to move a tip portion of the attachment along a target locus, wherein the processor is configured to limit the operation of the first actuator such that the operation of the first actuator corresponds to the operation of the second actuator, in response to determining that the processor has failed, or is likely to fail, to synchronize the operation of the second actuator with the operation of the first actuator to move the tip portion of the attachment along the target locus while controlling the operation of the second actuator in accordance with the operation of the first actuator to move the tip portion of the attachment along the target locus.

2. The shovel according to claim 1, wherein the processor is configured to determine that the processor has failed, or is likely to fail, to synchronize the operation of the second actuator with the operation of the first actuator, in response to determining that a predetermined condition is satisfied, the predetermined condition including a condition that a command value for the operation of the second actuator is more than a predetermined upper limit value.

3. The shovel according to claim 1, wherein the processor is configured to determine that the processor has failed, or is likely to fail, to synchronize the operation of the second actuator with the operation of the first actuator, in response to determining that a predetermined condition is satisfied, the predetermined condition including a condition that a difference between a command value for the operation of the second actuator and a measured value related to the operation of the second actuator corresponding to the command value is more than a predetermined threshold value.

4. The shovel according to claim 1, wherein the processor is configured to determine that the processor has failed, or is likely to fail, to synchronize the operation of the second actuator with the operation of the first actuator, in response to determining that a predetermined condition is satisfied, the predetermined condition including a condition that a measured value related to the operation of the second actuator is more than a predetermined upper limit value.

5. The shovel according to claim 1, wherein the processor is configured to slow down the operation of the first actuator corresponding to the operator's operation input or the operation command for the first actuator in response to determining that the processor has failed, or is likely to fail, to synchronize the operation of the second actuator with the operation of the first actuator.

6. The shovel according to claim 5, wherein the processor is configured to generate a command value for the operation of the first actuator according to an operation quantity of the operator's operation input or the operation command, control the first actuator on a basis of the generated command value for the operation of the first actuator, and cause the command value for the operation of the first actuator corresponding to the operation quantity to be smaller in magnitude in a case of determining that the processor has failed, or is likely to fail, to synchronize the operation of the second actuator with the operation of the first actuator than in a case of determining otherwise.

7. The shovel according to claim 1, wherein the attachment includes a boom, an arm, and a bucket, the plurality of actuators includes a boom cylinder configured to drive the boom, an arm cylinder configured to drive the arm, and a bucket cylinder configured to drive the bucket, and the processor is configured to limit an operation of the arm cylinder such that the operation of the arm cylinder corresponds to an operation of at least one of the boom cylinder or the bucket cylinder, in response to determining that the processor has failed, or is likely to fail, to synchronize the operation of the at least one of the boom cylinder or the bucket cylinder with the operation of the arm cylinder while controlling the operation of the at least one of the boom cylinder or the bucket cylinder in accordance with the operation of the arm cylinder during an excavation operation, the arm cylinder serving as the first actuator, the boom cylinder and the bucket cylinder each serving as the second actuator.

8. The shovel according to claim 1, wherein the plurality of actuators include a boom cylinder configured to drive a boom included in the attachment and a turning actuator configured to drive the upper turning body, and the processor is configured to limit an operation of the turning actuator such that the operation of the turning actuator corresponds to an operation of the boom cylinder in response to determining that the processor has failed, or is likely to fail, to synchronize the operation of the boom cylinder with the operation of the turning actuator while controlling the operation of the boom cylinder in accordance with the operation of the turning actuator during a boom raising and turning operation, the turning actuator serving as the first actuator, the boom cylinder serving as the second actuator.

9. The shovel according to claim 1, further comprising:

a spatial recognition device configured to recognize a situation in a surrounding of the shovel and output information indicative of the situation, wherein the processor is configured to disable one or more actuators of the plurality of actuators in response to determining, before the one or more actuators start to operate, that a person is present in a predetermined area from the shovel, based on the information indicative of the situation that is output by the spatial recognition device.

10. The shovel according to claim 1, further comprising:

a spatial recognition device configured to recognize a situation in a surrounding of the shovel and output information indicative of the situation; and an operating apparatus configured to receive the operator's operation input according to which one or more actuators of the plurality of actuators are operated, wherein the processor is configured not to allow the one or more actuators to operate even when the operating apparatus receives the operator's operation input, in response to determining, before the one or more actuators starts to operate, that a person is present in a predetermined area from the shovel, based on the information indicative of the situation that is output by the spatial recognition device.

11. A controller for a shovel, the shovel including a lower traveling body, an upper turning body turnably mounted on the lower traveling body, an attachment attached to the upper turning body, and a plurality of actuators including a first actuator and a second actuator and configured to drive the attachment and the upper turning body, the first actuator being configured to operate in response to an operator's operation input or an operation command of an autonomous driving function, the second actuator being configured to operate independent of the operator's operation input or the operation command, the controller comprising:

a processor configured to:

control an operation of the second actuator in accordance with an operation of the first actuator to move a tip portion of the attachment along a target locus; and limit the operation of the first actuator such that the operation of the first actuator corresponds to the operation of the second actuator, in response to determining that the processor has failed, or is likely to fail, to synchronize the operation of the second actuator with the operation of the first actuator to move the tip portion of the attachment along the target locus while controlling the operation of the second actuator in accordance with the operation of the first actuator to move the tip portion of the attachment along the target locus.

* * * * *